US011867012B2

(12) United States Patent
Hitchcock et al.

(10) Patent No.: US 11,867,012 B2
(45) Date of Patent: Jan. 9, 2024

(54) GAUGE CUTTER AND SAMPLER APPARATUS

(71) Applicant: Saudi Arabian Oil Company, Dhahran (SA)

(72) Inventors: Graham Hitchcock, Aberdeen (GB); Michael Affleck, Aberdeenshire (GB); Aslan Bulekbay, Udhailiyah (SA)

(73) Assignee: Saudi Arabian Oil Company, Dhahran (SA)

( * ) Notice: Subject to any disclaimer, the term of this patent is extended or adjusted under 35 U.S.C. 154(b) by 123 days.

(21) Appl. No.: 17/543,502

(22) Filed: Dec. 6, 2021

(65) Prior Publication Data

US 2023/0175335 A1 Jun. 8, 2023

(51) Int. Cl.
*E21B 27/00* (2006.01)
*E21B 37/00* (2006.01)
(Continued)

(52) U.S. Cl.
CPC ..... *E21B 27/005* (2013.01); *E21B 29/00* (2013.01); *E21B 37/00* (2013.01); *E21B 49/00* (2013.01); *E21B 17/1092* (2013.01); *E21B 17/18* (2013.01); *E21B 31/06* (2013.01); *E21B 47/00* (2013.01); *E21B 49/02* (2013.01)

(58) Field of Classification Search
CPC ..... E21B 17/1092; E21B 17/18; E21B 21/10; E21B 27/00; E21B 27/005; E21B 29/00; E21B 31/06; E21B 31/08; E21B 37/00; E21B 49/00; E21B 49/02
See application file for complete search history.

(56) References Cited

U.S. PATENT DOCUMENTS 381,374 A 4/1888 Hine
774,519 A 11/1904 Greenaway
(Continued)

FOREIGN PATENT DOCUMENTS

AU 2013206729 4/2015
CA 1226325 9/1987
(Continued)

OTHER PUBLICATIONS

U.S. Appl. No. 16/524,935, Zhan et al., filed Jul. 29, 2019.
(Continued)

*Primary Examiner* — Robert E Fuller
*Assistant Examiner* — Lamia Quaim
(74) *Attorney, Agent, or Firm* — Fish & Richardson P.C.

(57) ABSTRACT

An apparatus includes a first body, a second body, a shear pin, and a divider. The first body includes a coupling. The second body includes a cutter blade. The shear pin is configured to hold the position of the second body relative to the first body in an open position. The coupling is configured to couple the first body to the second body in a closed position. In the open position, the apparatus defines first and second flow paths for fluids and solids to pass through the apparatus. The first flow path is defined through the first body and through an inner bore of the divider. The second flow path is defined through the first body and through an annulus surrounding the divider. In the closed position, the second flow path is closed, such that solids remain in the annulus surrounding the divider.

20 Claims, 12 Drawing Sheets

(51) Int. Cl.

| | |
|---|---|
| ***E21B 49/00*** | (2006.01) |
| ***E21B 29/00*** | (2006.01) |
| *E21B 17/10* | (2006.01) |
| *E21B 17/18* | (2006.01) |
| *E21B 49/02* | (2006.01) |
| *E21B 31/06* | (2006.01) |
| *E21B 47/00* | (2012.01) |

(56) References Cited

U.S. PATENT DOCUMENTS 891,957 A 6/1908 Schubert
2,043,225 A 6/1936 Armentrout et al.
2,110,913 A 3/1938 Lowrey
2,227,729 A 1/1941 Lynes
2,286,673 A 6/1942 Douglas
2,305,062 A 12/1942 Church et al.
2,344,120 A 3/1944 Baker
2,368,424 A 1/1945 Reistle
2,757,738 A 9/1948 Ritchey
2,509,608 A 5/1950 Penfield
2,688,369 A 9/1954 Broyles
2,690,897 A 10/1954 Clark
2,719,363 A 10/1955 Richard et al.
2,763,314 A 9/1956 Gill
2,782,857 A 2/1957 Clark et al.
2,784,787 A 3/1957 Matthews et al.
2,795,279 A 6/1957 Erich
2,799,641 A 7/1957 Gordon
2,805,045 A 9/1957 Goodwin
2,822,150 A 2/1958 Muse et al.
2,841,226 A 7/1958 Conrad et al.
2,890,752 A 6/1959 Cron et al.
2,899,000 A 8/1959 Medders et al.
2,927,775 A 3/1960 Hildebrandt
3,016,244 A 1/1962 Friedrich et al.
3,028,915 A 4/1962 Jennings
3,071,399 A 1/1963 Cronin
3,087,552 A 4/1963 Graham
3,093,192 A 6/1963 Allen
3,102,599 A 9/1963 Hillburn
3,103,975 A 9/1963 Hanson
3,104,711 A 9/1963 Haagensen
3,114,875 A 12/1963 Haagensen
3,133,592 A 5/1964 Tomberlin
3,137,347 A 6/1964 Parker
3,149,672 A 9/1964 Joseph et al.
3,169,577 A 2/1965 Erich
3,170,519 A 2/1965 Haagensen
3,211,220 A 10/1965 Erich
3,220,478 A 11/1965 Kinzbach
3,228,470 A 1/1966 Papaila
3,236,307 A 2/1966 Brown
3,244,230 A 4/1966 Sharp
3,253,336 A 5/1966 Brown
3,268,003 A 8/1966 Essary
3,285,778 A 11/1966 Hauk
3,331,439 A 7/1967 Lawrence
3,369,605 A 2/1968 Donaldson et al.
3,386,514 A 6/1968 Weber
3,428,125 A 2/1969 Parker
3,468,373 A 9/1969 Smith
3,497,011 A 2/1970 Weber et al.
3,522,848 A 8/1970 New
3,547,192 A 12/1970 Claridge et al.
3,547,193 A 12/1970 Gill
3,572,431 A * 3/1971 Hammon ..... E21B 27/005 166/99
3,601,197 A 8/1971 Ayers et al.
3,642,066 A 2/1972 Gill
3,656,550 A 4/1972 Wagner, Jr. et al.
3,656,564 A 4/1972 Brown
3,695,356 A 10/1972 Argabright et al.
3,696,866 A 10/1972 Dryden
3,839,791 A 10/1974 Feamster
3,862,662 A 1/1975 Kern
3,866,682 A 2/1975 Jones et al.
3,874,450 A 4/1975 Kern
3,882,937 A 5/1975 Robinson
3,931,856 A 1/1976 Barnes
3,937,283 A 2/1976 Blauer et al.
3,946,809 A 3/1976 Hagedorn
3,948,319 A 4/1976 Pritchett
3,980,136 A 9/1976 Plummer et al.
4,008,762 A 2/1977 Fisher et al.
4,010,799 A 3/1977 Kern et al.
4,044,833 A 8/1977 Volz
4,064,211 A 12/1977 Wood
4,084,637 A 4/1978 Todd
4,106,562 A 8/1978 Barnes et al.
4,129,437 A 12/1978 Taguchi et al.
4,135,579 A 1/1979 Rowland et al.
4,140,179 A 2/1979 Kasevich et al.
4,140,180 A 2/1979 Bridges et al.
4,144,935 A 3/1979 Bridges et al.
4,157,116 A 6/1979 Coulter
4,191,493 A 3/1980 Hansson et al.
4,193,448 A 3/1980 Jearnbey
4,193,451 A 3/1980 Dauphine
4,196,329 A 4/1980 Rowland et al.
4,199,025 A 4/1980 Carpenter
4,216,829 A 8/1980 Murphy
4,265,307 A 5/1981 Elkins
RE30,738 E 9/1981 Bridges et al.
4,301,865 A 11/1981 Kasevich et al.
4,320,801 A 3/1982 Rowland et al.
4,334,928 A 6/1982 Hara
4,337,653 A 7/1982 Chauffe
4,340,405 A 7/1982 Steyert
4,343,651 A 8/1982 Yazu et al.
4,354,559 A 10/1982 Johnson
4,365,677 A 12/1982 Owens
4,373,581 A 2/1983 Toellner
4,394,170 A 7/1983 Sawaoka et al.
4,396,062 A 8/1983 Iskander
4,412,585 A 11/1983 Bouck
4,413,642 A 11/1983 Smith et al.
4,449,585 A 5/1984 Bridges et al.
4,457,365 A 7/1984 Kasevich et al.
4,464,993 A 8/1984 Porter
4,470,459 A 9/1984 Copland
4,476,926 A 10/1984 Bridges et al.
4,476,932 A 10/1984 Emery
4,484,627 A 11/1984 Perkins
4,485,868 A 12/1984 Sresty et al.
4,485,869 A 12/1984 Sresty et al.
4,487,257 A 12/1984 Dauphine
4,493,875 A 1/1985 Beck et al.
4,495,990 A 1/1985 Titus et al.
4,498,535 A 2/1985 Bridges
4,499,948 A 2/1985 Perkins
4,501,337 A 2/1985 Dickinson et al.
4,508,168 A 4/1985 Heeren
4,513,815 A 4/1985 Rundell et al.
4,524,826 A 6/1985 Savage
4,524,827 A 6/1985 Bridges et al.
4,532,992 A 8/1985 Coenen et al.
4,545,435 A 10/1985 Bridges et al.
4,553,592 A 11/1985 Looney et al.
4,557,327 A 12/1985 Kinley et al.
4,576,231 A 3/1986 Dowling et al.
4,583,589 A 4/1986 Kasevich
4,592,423 A 6/1986 Savage et al.
4,612,988 A 9/1986 Segalman
4,620,593 A 11/1986 Haagensen
4,636,934 A 1/1987 Schwendemann
RE32,345 E 3/1987 Wood
4,660,636 A 4/1987 Rundell et al.
4,660,643 A 4/1987 Perkins
4,705,108 A 11/1987 Little et al.
4,705,113 A 11/1987 Perkins
4,787,456 A 11/1988 Jennings, Jr. et al.
4,817,711 A 4/1989 Jearnbey
4,836,284 A 6/1989 Tinker

(56) References Cited

U.S. PATENT DOCUMENTS

| | | | |
|---|---|---|---|
| 4,846,277 | A | 7/1989 | Khalil et al. |
| 5,012,863 | A | 5/1991 | Springer |
| 5,018,578 | A | 5/1991 | El Rabaa et al. |
| 5,018,580 | A | 5/1991 | Skipper |
| 5,037,704 | A | 8/1991 | Nakai et al. |
| 5,055,180 | A | 10/1991 | Klaila |
| 5,068,819 | A | 11/1991 | Misra et al. |
| 5,069,283 | A | 12/1991 | Mack |
| 5,070,952 | A | 12/1991 | Neff |
| 5,074,355 | A | 12/1991 | Lennon |
| 5,082,054 | A | 1/1992 | Kiamanesh |
| 5,092,056 | A | 3/1992 | Deaton |
| 5,107,705 | A | 4/1992 | Wraight et al. |
| 5,107,931 | A | 4/1992 | Valka et al. |
| 5,228,518 | A | 7/1993 | Wilson et al. |
| 5,236,039 | A | 8/1993 | Edelstein et al. |
| 5,238,067 | A | 8/1993 | Jennings, Jr. |
| 5,278,550 | A | 1/1994 | Rhein-Knudsen et al. |
| 5,387,776 | A | 2/1995 | Preiser |
| 5,388,648 | A | 2/1995 | Jordan, Jr. |
| 5,394,339 | A | 2/1995 | Jones |
| 5,394,942 | A | 3/1995 | Catania |
| 5,429,198 | A | 7/1995 | Anderson et al. |
| 5,490,598 | A | 2/1996 | Adams |
| 5,501,248 | A | 3/1996 | Kiest, Jr. |
| 5,523,158 | A | 6/1996 | Kapoor et al. |
| 5,529,123 | A | 6/1996 | Carpenter et al. |
| 5,595,252 | A | 1/1997 | O'Hanlon |
| 5,603,070 | A | 2/1997 | Cerutti et al. |
| 5,604,184 | A | 2/1997 | Ellis et al. |
| 5,613,555 | A | 3/1997 | Sorem et al. |
| 5,690,826 | A | 11/1997 | Cravello |
| 5,803,186 | A | 9/1998 | Berger et al. |
| 5,803,666 | A | 9/1998 | Keller |
| 5,813,480 | A | 9/1998 | Zaleski, Jr. et al. |
| 5,853,049 | A | 12/1998 | Keller |
| 5,890,540 | A | 4/1999 | Pia et al. |
| 5,899,274 | A | 5/1999 | Frauenfeld et al. |
| 5,912,219 | A | 6/1999 | Carrie et al. |
| 5,947,213 | A | 9/1999 | Angle |
| 5,955,666 | A | 9/1999 | Mullins |
| 5,958,236 | A | 9/1999 | Bakula |
| RE36,362 | E | 11/1999 | Jackson |
| 5,987,385 | A | 11/1999 | Varsamis et al. |
| 6,008,153 | A | 12/1999 | Kukino et al. |
| 6,012,526 | A | 1/2000 | Jennings et al. |
| 6,032,539 | A | 3/2000 | Liu |
| 6,032,742 | A | 3/2000 | Tomlin et al. |
| 6,041,860 | A | 3/2000 | Nazzal et al. |
| 6,047,239 | A | 4/2000 | Berger et al. |
| 6,096,436 | A | 8/2000 | Inspektor |
| 6,170,531 | B1 | 1/2001 | Jung et al. |
| 6,173,795 | B1 | 1/2001 | McGarian et al. |
| 6,189,611 | B1 | 2/2001 | Kasevich |
| 6,207,620 | B1 | 3/2001 | Gonzalez et al. |
| 6,250,387 | B1 | 6/2001 | Carmichael et al. |
| 6,254,844 | B1 | 7/2001 | Takeuchi et al. |
| 6,263,970 | B1 | 7/2001 | Blanchet |
| 6,268,726 | B1 | 7/2001 | Prammer |
| 6,269,953 | B1 | 8/2001 | Seyffert et al. |
| 6,287,079 | B1 | 9/2001 | Gosling et al. |
| 6,290,068 | B1 | 9/2001 | Adams et al. |
| 6,305,471 | B1 | 10/2001 | Milloy |
| 6,325,216 | B1 | 12/2001 | Seyffert et al. |
| 6,328,111 | B1 | 12/2001 | Bearden et al. |
| 6,330,913 | B1 | 12/2001 | Langseth et al. |
| 6,347,675 | B1 | 2/2002 | Kolle |
| 6,354,371 | B1 | 3/2002 | O'Blanc |
| 6,371,302 | B1 | 4/2002 | Adams et al. |
| 6,413,399 | B1 | 7/2002 | Kasevich |
| 6,419,730 | B1 | 7/2002 | Chavez |
| 6,443,228 | B1 | 9/2002 | Aronstam |
| 6,454,099 | B1 | 9/2002 | Adams et al. |
| 6,469,278 | B1 | 10/2002 | Boyce |
| 6,510,947 | B1 | 1/2003 | Schulte et al. |
| 6,534,980 | B2 | 2/2003 | Toufaily et al. |
| 6,544,411 | B2 | 4/2003 | Varandaraj |
| 6,561,269 | B1 | 5/2003 | Brown et al. |
| 6,571,877 | B1 | 6/2003 | Van Bilderbeek |
| 6,585,046 | B2 | 7/2003 | Neuroth et al. |
| 6,607,080 | B2 | 8/2003 | Winkler et al. |
| 6,612,384 | B1 | 9/2003 | Singh et al. |
| 6,622,554 | B2 | 9/2003 | Manke et al. |
| 6,623,850 | B2 | 9/2003 | Kukino et al. |
| 6,629,610 | B1 | 10/2003 | Adams et al. |
| 6,637,092 | B1 | 10/2003 | Menzel |
| 6,678,616 | B1 | 1/2004 | Winkler et al. |
| 6,722,504 | B2 | 4/2004 | Schulte et al. |
| 6,729,409 | B1 | 5/2004 | Gupta et al. |
| 6,741,000 | B2 | 5/2004 | Newcomb |
| 6,761,230 | B2 | 7/2004 | Cross et al. |
| 6,766,856 | B1 | 7/2004 | McGee |
| 6,776,231 | B2 | 8/2004 | Allen |
| 6,776,235 | B1 | 8/2004 | England |
| 6,814,141 | B2 | 11/2004 | Huh et al. |
| 6,827,145 | B2 | 12/2004 | Fotland et al. |
| 6,845,818 | B2 | 1/2005 | Tutuncu et al. |
| 6,850,068 | B2 | 2/2005 | Chernali et al. |
| 6,883,605 | B2 | 4/2005 | Arceneaux et al. |
| 6,895,678 | B2 | 5/2005 | Ash et al. |
| 6,912,177 | B2 | 6/2005 | Smith |
| 6,971,265 | B1 | 12/2005 | Sheppard et al. |
| 6,988,552 | B2 | 1/2006 | Wilson et al. |
| 6,993,432 | B2 | 1/2006 | Jenkins et al. |
| 7,000,777 | B2 | 2/2006 | Adams et al. |
| 7,001,872 | B2 | 2/2006 | Pyecroft et al. |
| 7,013,992 | B2 | 3/2006 | Tessari et al. |
| 7,044,220 | B2 | 5/2006 | Nguyen et al. |
| 7,048,051 | B2 | 5/2006 | McQueen |
| 7,063,150 | B2 | 6/2006 | Slabaugh et al. |
| 7,063,155 | B2 | 6/2006 | Ruttley |
| 7,086,463 | B2 | 8/2006 | Ringgenberg et al. |
| 7,091,460 | B2 | 8/2006 | Kinzer |
| 7,109,457 | B2 | 9/2006 | Kinzer |
| 7,115,847 | B2 | 10/2006 | Kinzer |
| 7,124,819 | B2 | 10/2006 | Ciglenec et al. |
| 7,131,498 | B2 | 11/2006 | Campo et al. |
| 7,134,497 | B1 | 11/2006 | Chatterji et al. |
| 7,210,528 | B1 | 5/2007 | Brannon et al. |
| 7,216,767 | B2 | 5/2007 | Schulte et al. |
| 7,252,146 | B2 | 8/2007 | Slabaugh et al. |
| 7,255,169 | B2 | 8/2007 | van Batenburg et al. |
| 7,255,582 | B1 | 8/2007 | Liao |
| 7,281,580 | B2 | 10/2007 | Parker et al. |
| 7,281,581 | B2 | 10/2007 | Nyuyen et al. |
| 7,312,428 | B2 | 12/2007 | Kinzer |
| 7,322,776 | B2 | 1/2008 | Webb et al. |
| 7,331,385 | B2 | 2/2008 | Symington |
| 7,334,635 | B2 | 2/2008 | Nguyen |
| 7,334,636 | B2 | 2/2008 | Nguyen |
| 7,376,514 | B2 | 5/2008 | Habashy et al. |
| 7,387,174 | B2 | 6/2008 | Lurie |
| 7,395,878 | B2 | 7/2008 | Reitsma et al. |
| 7,422,060 | B2 | 9/2008 | Hammami et al. |
| 7,424,911 | B2 | 9/2008 | McCarthy et al. |
| 7,426,961 | B2 | 9/2008 | Stephenson et al. |
| 7,434,623 | B2 | 10/2008 | Von Gynz-Rekowski |
| 7,445,041 | B2 | 11/2008 | O'Brien |
| 7,451,812 | B2 | 11/2008 | Cooper et al. |
| 7,455,117 | B1 | 11/2008 | Hall et al. |
| 7,461,693 | B2 | 12/2008 | Considine et al. |
| 7,472,751 | B2 | 1/2009 | Brannon et al. |
| 7,484,561 | B2 | 2/2009 | Bridges |
| 7,516,787 | B2 | 4/2009 | Kaminsky |
| 7,539,548 | B2 | 5/2009 | Dhawan |
| 7,562,708 | B2 | 7/2009 | Cogliandro et al. |
| 7,571,767 | B2 | 8/2009 | Parker et al. |
| 7,581,590 | B2 | 9/2009 | Lesko et al. |
| 7,610,962 | B2 | 11/2009 | Fowler |
| 7,629,497 | B2 | 12/2009 | Pringle |
| 7,631,691 | B2 | 12/2009 | Symington et al. |
| 7,647,971 | B2 | 1/2010 | Kaminsky |
| 7,647,980 | B2 | 1/2010 | Corre et al. |
| 7,650,269 | B2 | 1/2010 | Rodney |

(56) References Cited

U.S. PATENT DOCUMENTS

| | | | |
|---|---|---|---|
| 7,677,317 | B2 | 3/2010 | Wilson |
| 7,677,673 | B2 | 3/2010 | Tranquilla et al. |
| 7,730,625 | B2 | 6/2010 | Blake |
| 7,735,548 | B2 | 6/2010 | Cherewyk |
| 7,767,628 | B2 | 8/2010 | Kippie et al. |
| 7,779,903 | B2 | 8/2010 | Bailey et al. |
| 7,789,148 | B2 | 9/2010 | Rayssiguier et al. |
| 7,803,740 | B2 | 9/2010 | Bicerano et al. |
| 7,828,057 | B2 | 11/2010 | Kearl et al. |
| 7,909,096 | B2 | 3/2011 | Clark et al. |
| 7,918,277 | B2 | 4/2011 | Brannon et al. |
| 7,951,482 | B2 | 5/2011 | Ichinose et al. |
| 7,980,392 | B2 | 7/2011 | Varco |
| 8,002,038 | B2 | 8/2011 | Wilson |
| 8,006,760 | B2 | 8/2011 | Fleming et al. |
| 8,066,068 | B2 | 11/2011 | Lesko et al. |
| 8,067,865 | B2 | 11/2011 | Savant |
| 8,096,349 | B2 | 1/2012 | Considine et al. |
| 8,100,190 | B2 | 1/2012 | Weaver |
| 8,104,537 | B2 | 1/2012 | Kaminsky |
| 8,119,576 | B2 | 2/2012 | Reyes et al. |
| 8,127,850 | B2 | 3/2012 | Brannon et al. |
| 8,176,977 | B2 | 5/2012 | Keller |
| 8,205,675 | B2 | 6/2012 | Brannon et al. |
| 8,210,256 | B2 | 7/2012 | Bridges et al. |
| 8,231,947 | B2 | 7/2012 | Vaidya et al. |
| 8,237,444 | B2 | 8/2012 | Simon |
| 8,245,792 | B2 | 8/2012 | Trinh et al. |
| 8,275,549 | B2 | 9/2012 | Sabag et al. |
| 8,286,734 | B2 | 10/2012 | Hannegan et al. |
| 8,408,305 | B2 | 4/2013 | Brannon et al. |
| 8,484,858 | B2 | 7/2013 | Brannigan et al. |
| 8,490,700 | B2 | 7/2013 | Lesko et al. |
| 8,511,404 | B2 | 8/2013 | Rasheed |
| 8,526,171 | B2 | 9/2013 | Wu et al. |
| 8,528,668 | B2 | 9/2013 | Rasheed |
| 8,550,174 | B1 | 10/2013 | Orgeron et al. |
| 8,567,491 | B2 | 10/2013 | Lurie |
| 8,584,755 | B2 | 11/2013 | Willberg et al. |
| 8,636,063 | B2 | 1/2014 | Ravi et al. |
| 8,636,065 | B2 | 1/2014 | Lesko et al. |
| 8,678,087 | B2 | 3/2014 | Schultz et al. |
| 8,683,859 | B2 | 4/2014 | Godager |
| 8,727,008 | B2 | 5/2014 | Krpec |
| 8,757,259 | B2 | 6/2014 | Lesko et al. |
| 8,763,699 | B2 | 7/2014 | Medvedev et al. |
| 8,776,609 | B2 | 7/2014 | Dria et al. |
| 8,794,062 | B2 | 8/2014 | DiFoggio et al. |
| 8,824,240 | B2 | 9/2014 | Roberts et al. |
| 8,884,624 | B2 | 11/2014 | Homan et al. |
| 8,925,213 | B2 | 1/2015 | Sallwasser |
| 8,936,083 | B2 | 1/2015 | Nguyen |
| 8,960,215 | B2 | 2/2015 | Cui et al. |
| 8,973,680 | B2 | 3/2015 | MacKenzie |
| 8,985,213 | B2 | 3/2015 | Saini et al. |
| 9,051,810 | B1 | 6/2015 | Cuffe et al. |
| 9,080,440 | B2 | 7/2015 | Panga et al. |
| 9,085,727 | B2 | 7/2015 | Litvinets et al. |
| 9,095,799 | B1 | 8/2015 | Packard |
| 9,097,094 | B1 | 8/2015 | Frost |
| 9,109,429 | B2 | 8/2015 | Xu et al. |
| 9,114,332 | B1 | 8/2015 | Liu |
| 9,181,789 | B2 | 11/2015 | Nevison |
| 9,217,291 | B2 | 12/2015 | Batarseh |
| 9,217,323 | B2 | 12/2015 | Clark |
| 9,222,350 | B2 | 12/2015 | Vaughn et al. |
| 9,238,953 | B2 | 1/2016 | Fleming et al. |
| 9,238,961 | B2 | 1/2016 | Bedouet |
| 9,250,339 | B2 | 2/2016 | Ramirez |
| 9,328,282 | B2 | 5/2016 | Li |
| 9,328,574 | B2 | 5/2016 | Sehsah |
| 9,353,589 | B2 | 5/2016 | Hekelaar |
| 9,355,440 | B1 | 5/2016 | Chen et al. |
| 9,394,782 | B2 | 7/2016 | DiGiovanni et al. |
| 9,435,159 | B2 | 9/2016 | Scott |
| 9,447,673 | B2 | 9/2016 | Medvedev et al. |
| 9,464,487 | B1 | 10/2016 | Zurn |
| 9,470,059 | B2 | 10/2016 | Zhou |
| 9,492,885 | B2 | 11/2016 | Zediker et al. |
| 9,494,010 | B2 | 11/2016 | Flores |
| 9,494,032 | B2 | 11/2016 | Roberson et al. |
| 9,523,268 | B2 | 12/2016 | Potapenko et al. |
| 9,528,366 | B2 | 12/2016 | Selman et al. |
| 9,562,987 | B2 | 2/2017 | Guner et al. |
| 9,567,819 | B2 | 2/2017 | Cavender et al. |
| 9,617,815 | B2 | 4/2017 | Schwartze et al. |
| 9,664,011 | B2 | 5/2017 | Kruspe et al. |
| 9,670,764 | B2 | 6/2017 | Lesko et al. |
| 9,702,211 | B2 | 7/2017 | Tinnen |
| 9,725,639 | B2 | 8/2017 | Vo et al. |
| 9,725,645 | B2 | 8/2017 | Monastiriotis et al. |
| 9,731,471 | B2 | 8/2017 | Schaedler et al. |
| 9,739,141 | B2 | 8/2017 | Zeng et al. |
| 9,757,796 | B2 | 9/2017 | Sherman et al. |
| 9,765,609 | B2 | 9/2017 | Chemali et al. |
| 9,777,562 | B2 | 10/2017 | Lastra et al. |
| 9,816,365 | B2 | 11/2017 | Nguyen et al. |
| 9,845,653 | B2 | 12/2017 | Hannegan et al. |
| 9,845,670 | B2 | 12/2017 | Surjaatmadja et al. |
| 9,863,230 | B2 | 1/2018 | Litvinets et al. |
| 9,863,231 | B2 | 1/2018 | Hull |
| 9,902,898 | B2 | 2/2018 | Nelson et al. |
| 9,903,010 | B2 | 2/2018 | Doud et al. |
| 9,909,404 | B2 | 3/2018 | Hwang et al. |
| 9,945,220 | B2 | 4/2018 | Saini et al. |
| 9,976,381 | B2 | 5/2018 | Martin et al. |
| 9,995,125 | B2 | 6/2018 | Madasu et al. |
| 10,000,983 | B2 | 6/2018 | Jackson et al. |
| 10,001,769 | B2 | 6/2018 | Huang et al. |
| 10,012,054 | B2 | 7/2018 | Ciglenec |
| 10,030,495 | B2 | 7/2018 | Litvinets et al. |
| 10,047,281 | B2 | 8/2018 | Nguyen et al. |
| 10,077,396 | B2 | 9/2018 | Nguyen et al. |
| 10,087,364 | B2 | 10/2018 | Kaufman et al. |
| 10,100,245 | B1 | 10/2018 | Bulekbay et al. |
| 10,113,406 | B1 | 10/2018 | Gomaa et al. |
| 10,113,408 | B2 | 10/2018 | Pobedinski et al. |
| 10,174,577 | B2 | 1/2019 | Leuchtenberg et al. |
| 10,208,239 | B2 | 2/2019 | Ballard |
| 10,233,372 | B2 | 3/2019 | Ramasamy et al. |
| 10,329,877 | B2 | 6/2019 | Simpson et al. |
| 10,352,125 | B2 | 7/2019 | Frazier |
| 10,392,910 | B2 | 8/2019 | Walton et al. |
| 10,394,193 | B2 | 8/2019 | Li et al. |
| 10,421,897 | B2 | 9/2019 | Skiba et al. |
| 10,450,839 | B2 | 10/2019 | Bulekbay et al. |
| 10,508,517 | B2 | 12/2019 | Bulekbay et al. |
| 10,544,640 | B2 | 1/2020 | Hekelaar |
| 10,550,314 | B2 | 2/2020 | Liang et al. |
| 10,551,800 | B2 | 2/2020 | Li et al. |
| 10,641,079 | B2 | 5/2020 | Aljubran et al. |
| 10,655,443 | B2 | 5/2020 | Gomma et al. |
| 10,673,238 | B2 | 6/2020 | Boone et al. |
| 10,836,956 | B2 | 11/2020 | Bulekbay et al. |
| 10,858,578 | B2 | 12/2020 | Bulekbay et al. |
| 10,883,042 | B2 | 1/2021 | Bulekbay |
| 10,927,618 | B2 | 2/2021 | Albahrani et al. |
| 10,995,263 | B2 | 5/2021 | Bulekbay et al. |
| 10,999,946 | B2 | 5/2021 | Li et al. |
| 11,008,816 | B2 | 5/2021 | Zhan et al. |
| 11,242,738 | B2 | 2/2022 | Bulekbay et al. |
| 2002/0043507 | A1 | 4/2002 | McCulloch |
| 2002/0066563 | A1 | 6/2002 | Langseth et al. |
| 2003/0052098 | A1 | 3/2003 | Kim et al. |
| 2003/0159776 | A1 | 8/2003 | Graham |
| 2003/0230526 | A1 | 12/2003 | Okabayshi et al. |
| 2004/0173244 | A1 | 9/2004 | Strothoff et al. |
| 2004/0182574 | A1 | 9/2004 | Sarmad et al. |
| 2004/0256103 | A1 | 12/2004 | Batarseh |
| 2004/0261999 | A1 | 12/2004 | Nguyen |
| 2005/0022987 | A1 | 2/2005 | Green et al. |
| 2005/0092523 | A1 | 5/2005 | McCaskill et al. |
| 2005/0097911 | A1 | 5/2005 | Revellat |
| 2005/0126784 | A1 | 6/2005 | Dalton |

(56) References Cited

U.S. PATENT DOCUMENTS

2005/0137094 A1 6/2005 Weaver et al.
2005/0194147 A1 9/2005 Metcalf et al.
2005/0199386 A1 9/2005 Kinzer
2005/0205266 A1 9/2005 Todd et al.
2005/0259512 A1 11/2005 Mandal
2006/0016592 A1 1/2006 Wu
2006/0035808 A1 2/2006 Ahmed et al.
2006/0073980 A1 4/2006 Brannon et al.
2006/0076347 A1 4/2006 Kinzer
2006/0102625 A1 5/2006 Kinzer
2006/0106541 A1 5/2006 Hassan et al.
2006/0144619 A1 7/2006 Storm
2006/0144620 A1 7/2006 Cooper
2006/0185843 A1 8/2006 Smith
2006/0248949 A1 11/2006 Gregory et al.
2006/0249307 A1 11/2006 Ritter
2007/0000662 A1 1/2007 Symington et al.
2007/0012437 A1 1/2007 Clingman et al.
2007/0017669 A1 1/2007 Lurie
2007/0108202 A1 5/2007 Kinzer
2007/0131591 A1 6/2007 Pringle
2007/0137852 A1 6/2007 Considine et al.
2007/0137858 A1 6/2007 Considine et al.
2007/0153626 A1 7/2007 Hayes et al.
2007/0175633 A1 8/2007 Kosmala
2007/0181301 A1 8/2007 O'Brien
2007/0187089 A1 8/2007 Bridges
2007/0193744 A1 8/2007 Bridges
2007/0204994 A1 9/2007 Wimmersperg
2007/0215355 A1 9/2007 Shapovalov
2007/0261844 A1 11/2007 Cogliandro et al.
2007/0289736 A1 12/2007 Kearl et al.
2008/0007421 A1 1/2008 Liu et al.
2008/0047337 A1 2/2008 Chemali et al.
2008/0053652 A1 3/2008 Corre et al.
2008/0073079 A1 3/2008 Tranquilla et al.
2008/0135242 A1 6/2008 Lesko
2008/0149329 A1 6/2008 Cooper
2008/0153718 A1 6/2008 Heidenfelder et al.
2008/0173443 A1 7/2008 Symington et al.
2008/0173480 A1 7/2008 Annaiyappa et al.
2008/0190822 A1 8/2008 Young
2008/0202764 A1 8/2008 Clayton et al.
2008/0223579 A1 9/2008 Goodwin
2008/0308282 A1 12/2008 Standridge et al.
2008/0312892 A1 12/2008 Heggemann
2009/0044945 A1 2/2009 Willberg et al.
2009/0139720 A1 6/2009 Frazier
2009/0151944 A1 6/2009 Fuller et al.
2009/0153354 A1 6/2009 Daussin
2009/0164125 A1 6/2009 Bordakov et al.
2009/0178809 A1 7/2009 Jeffryes et al.
2009/0183875 A1 7/2009 Rayssiguier et al.
2009/0255689 A1 10/2009 Kriesels et al.
2009/0259446 A1 10/2009 Zhang et al.
2009/0288820 A1 11/2009 Barron et al.
2009/0298720 A1 12/2009 Nguyen et al.
2010/0006339 A1 1/2010 Desai
2010/0043823 A1 2/2010 Lee
2010/0089583 A1 4/2010 Xu et al.
2010/0186955 A1 7/2010 Saasen et al.
2010/0276209 A1 11/2010 Yong et al.
2010/0282468 A1 11/2010 Willberg et al.
2010/0282511 A1 11/2010 Maranuk
2010/0323933 A1 12/2010 Fuller
2011/0005753 A1 1/2011 Todd et al.
2011/0011576 A1 1/2011 Cavender et al.
2011/0031026 A1 2/2011 Oxford et al.
2011/0058916 A1 3/2011 Toosky
2011/0120732 A1 5/2011 Lurie
2011/0155368 A1 6/2011 El-Khazindar
2011/0220416 A1 9/2011 Rives
2011/0247833 A1 10/2011 Todd et al.
2011/0251111 A1 10/2011 Lin et al.
2012/0012319 A1 1/2012 Dennis
2012/0018143 A1 1/2012 Lembcke
2012/0075615 A1 3/2012 Niclass et al.
2012/0097392 A1 4/2012 Reyes et al.
2012/0111578 A1 5/2012 Tverlid
2012/0112546 A1 5/2012 Culver
2012/0118571 A1* 5/2012 Zhou ..... E21B 31/08 166/99
2012/0125618 A1 5/2012 Willberg
2012/0132418 A1 5/2012 McClung
2012/0132468 A1 5/2012 Scott et al.
2012/0152543 A1 6/2012 Davis
2012/0169841 A1 6/2012 Chemali et al.
2012/0173196 A1 7/2012 Miszewski
2012/0181020 A1 7/2012 Barron et al.
2012/0186817 A1 7/2012 Gibson et al.
2012/0222854 A1 9/2012 McClung, III
2012/0227983 A1 9/2012 Lymberopoulous et al.
2012/0247764 A1 10/2012 Panga
2012/0273187 A1 11/2012 Hall
2012/0305247 A1 12/2012 Chen et al.
2012/0325564 A1 12/2012 Vaughn et al.
2013/0008653 A1 1/2013 Schultz et al.
2013/0008671 A1 1/2013 Booth
2013/0025943 A1 1/2013 Kumar
2013/0032549 A1 2/2013 Brown et al.
2013/0037268 A1 2/2013 Kleefisch et al.
2013/0068525 A1 3/2013 Digiovanni
2013/0076525 A1 3/2013 Vu et al.
2013/0125642 A1 5/2013 Parfitt
2013/0126164 A1 5/2013 Sweatman et al.
2013/0126169 A1 5/2013 Al-Nakhli et al.
2013/0146359 A1 6/2013 Koederitz
2013/0160992 A1 6/2013 Agrawal et al.
2013/0161003 A1 6/2013 Mikhailovich et al.
2013/0191029 A1 7/2013 Heck, Sr.
2013/0192839 A1 8/2013 Brown et al.
2013/0213637 A1 8/2013 Kearl
2013/0255936 A1 10/2013 Statoilydro et al.
2013/0260649 A1 10/2013 Thomson
2013/0269945 A1 10/2013 Mulholland et al.
2013/0308424 A1 11/2013 Kumar
2013/0312977 A1 11/2013 Lembcke
2013/0333892 A1 12/2013 McClung, IV
2013/0341027 A1 12/2013 Xu et al.
2014/0000899 A1 1/2014 Nevison
2014/0020708 A1 1/2014 Kim et al.
2014/0034144 A1 2/2014 Cui et al.
2014/0047776 A1 2/2014 Scott et al.
2014/0083771 A1 3/2014 Clark
2014/0090846 A1 4/2014 Deutch
2014/0131040 A9 5/2014 Panga
2014/0132468 A1 5/2014 Scott et al.
2014/0144633 A1 5/2014 Nguyen
2014/0144634 A1 5/2014 Nguyen
2014/0144635 A1 5/2014 Nguyen
2014/0183143 A1 7/2014 Cady et al.
2014/0202712 A1 7/2014 Fripp et al.
2014/0231068 A1 8/2014 Isaksen
2014/0231075 A1 8/2014 Springett et al.
2014/0231147 A1 8/2014 Bozso et al.
2014/0238658 A1 8/2014 Wilson et al.
2014/0246209 A1 9/2014 Themig et al.
2014/0246235 A1 9/2014 Yao
2014/0251593 A1 9/2014 Oberg et al.
2014/0251894 A1 9/2014 Larson et al.
2014/0265337 A1 9/2014 Harding et al.
2014/0270793 A1 9/2014 Bradford
2014/0278111 A1 9/2014 Gerrie et al.
2014/0290943 A1 10/2014 Ladva
2014/0291023 A1 10/2014 Edbury
2014/0296113 A1 10/2014 Reyes
2014/0300895 A1 10/2014 Pope et al.
2014/0326506 A1 11/2014 Difoggio
2014/0333754 A1 11/2014 Graves et al.
2014/0352954 A1 12/2014 Lakhtychkin et al.
2014/0360778 A1 12/2014 Batarseh
2014/0375468 A1 12/2014 Wilkinson et al.
2015/0020908 A1 1/2015 Warren
2015/0021240 A1 1/2015 Wardell et al.

(56) References Cited

U.S. PATENT DOCUMENTS

| | | | |
|---|---|---|---|
| 2015/0027724 | A1 | 1/2015 | Symms |
| 2015/0047846 | A1 | 2/2015 | Oort |
| 2015/0071750 | A1 | 3/2015 | Foster |
| 2015/0075714 | A1 | 3/2015 | Sun et al. |
| 2015/0075797 | A1 | 3/2015 | Li |
| 2015/0083420 | A1 | 3/2015 | Gupta et al. |
| 2015/0083422 | A1 | 3/2015 | Pritchard |
| 2015/0091737 | A1 | 4/2015 | Richardson et al. |
| 2015/0101864 | A1 | 4/2015 | May |
| 2015/0129306 | A1 | 5/2015 | Coffman et al. |
| 2015/0159467 | A1 | 6/2015 | Hartman et al. |
| 2015/0211346 | A1 | 7/2015 | Potapenko |
| 2015/0211362 | A1 | 7/2015 | Rogers |
| 2015/0218439 | A1 | 8/2015 | Dean et al. |
| 2015/0239795 | A1 | 8/2015 | Doud et al. |
| 2015/0259593 | A1 | 9/2015 | Kaufman et al. |
| 2015/0267500 | A1 | 9/2015 | Van Dogen |
| 2015/0275644 | A1 | 10/2015 | Chen et al. |
| 2015/0284833 | A1 | 10/2015 | Hsiao et al. |
| 2015/0285026 | A1 | 10/2015 | Frazier |
| 2015/0290878 | A1 | 10/2015 | Houben et al. |
| 2015/0300151 | A1 | 10/2015 | Mohaghegh |
| 2015/0345261 | A1 | 12/2015 | Kruspe et al. |
| 2015/0369028 | A1 | 12/2015 | Potapenko |
| 2016/0053572 | A1 | 2/2016 | Snoswell |
| 2016/0053604 | A1 | 2/2016 | Abbassian |
| 2016/0076357 | A1 | 3/2016 | Hbaieb |
| 2016/0115783 | A1 | 4/2016 | Zeng et al. |
| 2016/0130928 | A1 | 5/2016 | Torrione et al. |
| 2016/0153240 | A1 | 6/2016 | Braga et al. |
| 2016/0153274 | A1 | 6/2016 | Hull et al. |
| 2016/0160106 | A1 | 6/2016 | Jamison et al. |
| 2016/0194157 | A1 | 7/2016 | Senn et al. |
| 2016/0208591 | A1 | 7/2016 | Weaver et al. |
| 2016/0215205 | A1 | 7/2016 | Nguyen et al. |
| 2016/0215604 | A1 | 7/2016 | Potapenko et al. |
| 2016/0237810 | A1 | 8/2016 | Beaman et al. |
| 2016/0247316 | A1 | 8/2016 | Whalley et al. |
| 2016/0319189 | A1 | 11/2016 | Dusterhoft |
| 2016/0339517 | A1 | 11/2016 | Joshi et al. |
| 2016/0341019 | A1 | 11/2016 | Qiu et al. |
| 2016/0347994 | A1 | 12/2016 | Purdy et al. |
| 2016/0356125 | A1 | 12/2016 | Bello et al. |
| 2016/0369154 | A1 | 12/2016 | Johnson et al. |
| 2017/0051785 | A1 | 2/2017 | Cooper |
| 2017/0058620 | A1 | 3/2017 | Torrione |
| 2017/0066962 | A1 | 3/2017 | Ravi et al. |
| 2017/0077705 | A1 | 3/2017 | Kuttel et al. |
| 2017/0089153 | A1 | 3/2017 | Teodorescu |
| 2017/0121593 | A1 | 5/2017 | Pantsurkin |
| 2017/0138190 | A1 | 5/2017 | Elkatatny et al. |
| 2017/0161885 | A1 | 6/2017 | Parmeshwar et al. |
| 2017/0204703 | A1 | 7/2017 | Mair |
| 2017/0234104 | A1 | 8/2017 | James |
| 2017/0292376 | A1 | 10/2017 | Kumar et al. |
| 2017/0314335 | A1 | 11/2017 | Kosonde et al. |
| 2017/0314369 | A1 | 11/2017 | Rosano et al. |
| 2017/0328196 | A1 | 11/2017 | Shi et al. |
| 2017/0328197 | A1 | 11/2017 | Shi et al. |
| 2017/0332482 | A1 | 11/2017 | Hauslmann |
| 2017/0342776 | A1 | 11/2017 | Bullock et al. |
| 2017/0350201 | A1 | 12/2017 | Shi et al. |
| 2017/0350241 | A1 | 12/2017 | Shi |
| 2018/0010030 | A1 | 1/2018 | Ramasamy et al. |
| 2018/0010419 | A1 | 1/2018 | Livescu et al. |
| 2018/0029942 | A1 | 2/2018 | Ishida |
| 2018/0171772 | A1 | 6/2018 | Rodney |
| 2018/0171774 | A1 | 6/2018 | Ringer et al. |
| 2018/0177064 | A1 | 6/2018 | Van Pol et al. |
| 2018/0187498 | A1 | 7/2018 | Soto et al. |
| 2018/0202278 | A1 | 7/2018 | Nelson et al. |
| 2018/0223624 | A1 | 8/2018 | Fripp et al. |
| 2018/0230361 | A1 | 8/2018 | Foster |
| 2018/0238133 | A1 | 8/2018 | Fripp et al. |
| 2018/0240322 | A1 | 8/2018 | Potucek et al. |
| 2018/0244981 | A1 | 8/2018 | Panga et al. |
| 2018/0265416 | A1 | 9/2018 | Ishida et al. |
| 2018/0266226 | A1 | 9/2018 | Batarseh et al. |
| 2018/0315111 | A1 | 11/2018 | Alvo et al. |
| 2018/0326679 | A1 | 11/2018 | Weisenberg et al. |
| 2018/0328156 | A1 | 11/2018 | Slater |
| 2018/0334612 | A1 | 11/2018 | Bulekbay et al. |
| 2018/0334883 | A1 | 11/2018 | Williamson |
| 2018/0363404 | A1 | 12/2018 | Faugstad |
| 2018/0371860 | A1 | 12/2018 | Fripp et al. |
| 2019/0009033 | A1 | 1/2019 | Butler et al. |
| 2019/0049054 | A1 | 2/2019 | Gunnarsson et al. |
| 2019/0055818 | A1 | 2/2019 | Bulekbay |
| 2019/0078426 | A1 | 3/2019 | Zheng et al. |
| 2019/0078626 | A1 | 3/2019 | Silsson |
| 2019/0090056 | A1 | 3/2019 | Rexach et al. |
| 2019/0090330 | A1 | 3/2019 | Aykroyd et al. |
| 2019/0100988 | A1 | 4/2019 | Brian et al. |
| 2019/0101872 | A1 | 4/2019 | Li |
| 2019/0106959 | A1 | 4/2019 | Leonard et al. |
| 2019/0145183 | A1 | 5/2019 | Potash |
| 2019/0147125 | A1 | 5/2019 | Yu et al. |
| 2019/0169953 | A1 | 6/2019 | Frazier |
| 2019/0194519 | A1 | 6/2019 | Amanullah |
| 2019/0218883 | A1 | 7/2019 | Inglis et al. |
| 2019/0227499 | A1 | 7/2019 | Li et al. |
| 2019/0257180 | A1 | 8/2019 | Kriesels et al. |
| 2019/0264095 | A1 | 8/2019 | Qu et al. |
| 2019/0267805 | A1 | 8/2019 | Kothuru et al. |
| 2019/0282089 | A1 | 9/2019 | Wang |
| 2019/0323320 | A1 | 10/2019 | Bulekbay et al. |
| 2019/0323332 | A1 | 10/2019 | Cuellar et al. |
| 2019/0345377 | A1 | 11/2019 | Haque et al. |
| 2020/0032638 | A1 | 1/2020 | Ezzeddine |
| 2020/0040680 | A1 | 2/2020 | Mhaskar et al. |
| 2020/0081439 | A1 | 3/2020 | Mukherjee et al. |
| 2020/0125040 | A1 | 4/2020 | Li et al. |
| 2020/0157929 | A1 | 5/2020 | Torrione |
| 2020/0182043 | A1 | 6/2020 | Downey et al. |
| 2020/0190959 | A1 | 6/2020 | Gooneratne et al. |
| 2020/0190963 | A1 | 6/2020 | Gooneratne et al. |
| 2020/0190967 | A1 | 6/2020 | Gooneratne et al. |
| 2020/0230524 | A1 | 7/2020 | Bulekbay et al. |
| 2020/0240258 | A1 | 7/2020 | Stokely et al. |
| 2020/0248546 | A1 | 8/2020 | Torrione et al. |
| 2020/0368967 | A1 | 11/2020 | Zhan et al. |
| 2020/0370381 | A1 | 11/2020 | Al-Rubaii et al. |
| 2020/0371495 | A1 | 11/2020 | Al-Rubaii et al. |
| 2021/0032934 | A1 | 2/2021 | Zhan et al. |
| 2021/0032935 | A1 | 2/2021 | Zhan et al. |
| 2021/0032936 | A1 | 2/2021 | Zhan et al. |
| 2021/0034029 | A1 | 2/2021 | Zhan et al. |
| 2021/0340866 | A1 | 11/2021 | Zhan et al. |
| 2022/0018241 | A1 | 1/2022 | Affleck |
| 2022/0025758 | A1 | 1/2022 | Mora et al. |

FOREIGN PATENT DOCUMENTS

| | | |
|---|---|---|
| CA | 2249432 | 9/2005 |
| CA | 2537585 | 8/2006 |
| CA | 2669721 | 7/2011 |
| CA | 2594042 | 8/2012 |
| CN | 1425846 | 6/2003 |
| CN | 101079591 | 11/2007 |
| CN | 200989202 | 12/2007 |
| CN | 101644151 | 2/2010 |
| CN | 102493813 | 6/2012 |
| CN | 203232293 | 10/2013 |
| CN | 104295448 | 1/2015 |
| CN | 104712288 | 6/2015 |
| CN | 104727799 | 6/2015 |
| CN | 204627586 | 9/2015 |
| CN | 105041288 | 11/2015 |
| CN | 102777138 | 1/2016 |
| CN | 105693947 | 6/2016 |
| CN | 106119763 | 11/2016 |
| CN | 107208478 | 9/2017 |
| CN | 107462222 | 12/2017 |
| CN | 108240191 | 7/2018 |

(56) References Cited

FOREIGN PATENT DOCUMENTS

| | | |
|---|---|---|
| CN | 109437920 | 3/2019 |
| CN | 110571475 | 12/2019 |
| DE | 102008001607 | 11/2009 |
| DE | 102011008809 | 7/2012 |
| DE | 102012022453 | 5/2014 |
| DE | 102013200450 | 7/2014 |
| DE | 102012205757 | 8/2014 |
| EP | 306546 | 3/1989 |
| EP | 2317068 | 5/2011 |
| EP | 2574722 | 4/2013 |
| EP | 2737173 | 6/2014 |
| EP | 3034778 | 6/2016 |
| EP | 3333141 | 6/2018 |
| FR | 2920435 | 8/2007 |
| FR | 3051699 | 12/2017 |
| GB | 239998 | 9/1925 |
| GB | 2063840 | 6/1981 |
| GB | 2124855 | 2/1984 |
| GB | 2155519 | 9/1985 |
| GB | 2357305 | 6/2001 |
| GB | 2399515 | 9/2004 |
| GB | 2422125 | 7/2006 |
| GB | 2466376 | 6/2010 |
| GB | 2484166 | 4/2012 |
| GB | 2532967 | 6/2016 |
| JP | 2009067609 | 4/2009 |
| JP | 4275896 | 6/2009 |
| JP | 5013156 | 8/2012 |
| JP | 2013110910 | 6/2013 |
| JP | 2020534460 | 11/2020 |
| NO | 343139 | 11/2018 |
| NO | 20161842 | 5/2019 |
| RU | 2282708 | 8/2006 |
| RU | 122531 | 11/2012 |
| WO | WO 1992019838 | 11/1992 |
| WO | WO 1995035429 | 12/1995 |
| WO | WO 1997021904 | 6/1997 |
| WO | WO 2000025942 | 5/2000 |
| WO | WO 00/31374 | 6/2000 |
| WO | WO 2000031374 | 6/2000 |
| WO | WO 2001042622 | 6/2001 |
| WO | WO 2002020944 | 3/2002 |
| WO | WO 2002068793 | 9/2002 |
| WO | WO 03/042494 | 5/2003 |
| WO | WO 2004042185 | 5/2004 |
| WO | WO 2006108161 | 10/2006 |
| WO | WO 2016108161 | 10/2006 |
| WO | WO 2007049026 | 5/2007 |
| WO | WO 2007070305 | 6/2007 |
| WO | WO 2008146017 | 12/2008 |
| WO | WO 2009018536 | 2/2009 |
| WO | WO 2009020889 | 2/2009 |
| WO | WO 2009113895 | 9/2009 |
| WO | WO 2010026553 | 3/2010 |
| WO | WO 2010054353 | 5/2010 |
| WO | WO 2010105177 | 9/2010 |
| WO | WO 2011038170 | 3/2011 |
| WO | WO 2011042622 | 6/2011 |
| WO | WO 2011130159 | 10/2011 |
| WO | WO 2011139697 | 11/2011 |
| WO | WO 2012007407 | 1/2012 |
| WO | WO 2013016095 | 1/2013 |
| WO | WO 2013148510 | 10/2013 |
| WO | WO 2014127035 | 8/2014 |
| WO | WO 2015012818 | 1/2015 |
| WO | WO 2015071750 | 5/2015 |
| WO | WO 2015072971 | 5/2015 |
| WO | WO 2015073001 | 5/2015 |
| WO | WO 2015095155 | 6/2015 |
| WO | WO 2015130419 | 9/2015 |
| WO | WO 2016032578 | 3/2016 |
| WO | WO 2016178005 | 11/2016 |
| WO | WO 2017011078 | 1/2017 |
| WO | WO 2017027105 | 2/2017 |
| WO | WO 2017040553 | 3/2017 |
| WO | WO 2017132297 | 8/2017 |
| WO | WO 2017164878 | 9/2017 |
| WO | WO 2017196303 | 11/2017 |
| WO | WO 2018022198 | 2/2018 |
| WO | WO 2018046361 | 3/2018 |
| WO | WO 2018167022 | 9/2018 |
| WO | WO 2018169991 | 9/2018 |
| WO | WO 2019027830 | 2/2019 |
| WO | WO 2019040091 | 2/2019 |
| WO | WO 2019055240 | 3/2019 |
| WO | WO 2019089926 | 5/2019 |
| WO | WO 2019108931 | 6/2019 |
| WO | WO 2019117857 | 6/2019 |
| WO | WO 2019160859 | 8/2019 |
| WO | WO 2019169067 | 9/2019 |
| WO | WO 2019236288 | 12/2019 |
| WO | WO 2019246263 | 12/2019 |

OTHER PUBLICATIONS

U.S. Appl. No. 16/708,834, Li et al., filed Dec. 10, 2019.
U.S. Appl. No. 16/708,865, Li et al., filed Dec. 10, 2019.
U.S. Appl. No. 16/708,872, Li et al., filed Dec. 10, 2019.
U.S. Appl. No. 16/831,426, Li et al., filed Mar. 26, 2020.
U.S. Appl. No. 16/831,483, Li et al., filed Mar. 26, 2020.
U.S. Appl. No. 16/831,559, Li et al., filed Mar. 26, 2020.
U.S. Appl. No. 16/897,794, Li et al., filed Jun. 10, 2020.
U.S. Appl. No. 16/897,801, Li et al., filed Jun. 10, 2020.
U.S. Appl. No. 16/897,805, Li et al., filed Jun. 10, 2020.
U.S. Appl. No. 17/142,855, Bulekbay et al., filed Jan. 6, 2021.
"Echo Dissolvable Fracturing Plug," EchoSeries, Dissolvable Fracturing Plugs, Gryphon Oilfield Solutions, Aug. 2018, 1 page.
"Gauge Cutter" LiMAR, available on or before Jul. 2021, 2 pages.
"Gauge Ring Sample Catcher" LiMAR, available on or before Apr. 2014, 2 pages.
"Hole Cleaning," Petrowiki, retrieved on Jan. 25, 2019, 8 pages.
"IADC Dull Grading for PDC Drill Bits," Beste Bit, SPE/IADC 23939, 1992, 52 pages.
"Slickline Downhole Basic Tools Data Sheets" ELAA Dynamics, 2018, 34 pages.
"Wireline & Flow Control Products" Elmar Tools, available on or before Jun. 21, 2021, 6 pages.
Akersolutions, "Aker MH CCTC Improving Safety," AkerSolutions, Jan. 2008, 12 pages.
Alipour-Kivi et al, "Automated Liquid Unloading in Low-Pressure Gas Wells Using Intermittent and Distributed Heating of Wellbore Fluid," SPE 100650, Society of Petroleum Engineers (SPE), presented at the SPE Western Regional/AAPG Pacific Section/GSA Cordilleran Section Joint Meeting, 2006, 6 pages.
Ansari et al., "Innovative Planning and Remediation Techniques for Restoring the Well Integrity by Curing High Annulus-B Pressure and Zonal Communications," IPTC-18894-MS, International Petroleum Technology Conference (IPTC), presented at the International Petroleum Technology Conference, Nov. 14-16, 2016, 24 pages.
Anwar et al., "Fog computing: an overview of big IoT data analytics," ID 7157192, Wiley, Hindawi, Wireless communications and mobile computing, May 2018, 2018: 1-22, 23 pages.
Artymiuk et al., "The new drilling control and monitoring system," Acta Montanistica Slovaca, Sep. 2004, 9(3): 145-151, 7 pages.
Ashby et al., "Coiled Tubing Conveyed Video Camera and Multi-Arm Caliper Liner Damage Diagnostics Post Plug and Perf Frac," SPE-172622-MS, Society of Petroleum Engineers (SPE), presented at the SPE Middle East Oil & Gas Show and Conference, Mar. 8-11, 2015, 12 pages.
Barree et al., "Realistic Assessment of Proppant Pack Conductivity for Material Selection," SPE-84306-MS, Society of Petroleum Engineers (SPE), presented at the Annual Technical Conference, Oct. 5-8, 2003, 12 pages.
Bilal et al., "Potentials, trends, and prospects in edge technologies: Fog, cloudlet, mobile edge, and micro data centers," Computer Networks, Elsevier, Oct. 2017, 130: 94-120, 27 pages.
Carpenter, "Advancing Deepwater Kick Detection," JPT, 68:5, May 2016, 2 pages.

(56) References Cited

OTHER PUBLICATIONS

Caryotakis, "The klystron: A microwave source of surprising range and endurance." The American Physical Society, Division of Plasma Physics Conference in Pittsburg, PA, Nov. 1997, 14 pages.
Chatar et al., "Determining Rig State from Computer Vision Analytics," SPE/IADC-204086-MS, Society of Petroleum Engineers, Mar. 2021, 15 pages.
Clifton, "Modeling of In-Situ Stress Change Due to Cold Fluid Injection," SPE 22107, Society of Petroleum Engineers (SPE), presented at the International Arctic Technology Conference, May 29-31, 1991, 13 pages.
Commer et al., "New advances in three-dimensional controlled-source electromagnetic inversion," Geophys. J. Int., 2008, 172: 513-535, 23 pages.
Corona et al., "Novel Washpipe-Free ICD Completion With Dissolvable Material," OTC-28863-MS, presented at the Offshore Technology Conference, Houston, TX, Apr. 30-May 3, 2018, 2018, OTC, 10 pages.
Decker et al., "Opportunities for Waste Heat Recovery at Contingency Bases," Construction Engineering Research Laboratory (CERL), US Army Corps of Engineers, ERDC, Apr. 2016, 61 pages.
Dickens et al., "An LED array-based light induced fluorescence sensor for real-time process and field monitoring," Sensors and Actuators B: Chemical, Elsevier, Apr. 2011, 158:1 (35-42), 8 pages.
Dong et al., "Dual Substitution and Spark Plasma Sintering to Improve Ionic Conductivity of Garnet Li7La3Zr2O12," Nanomaterials, 9:721, 2019, 10 pages.
Downholediagnostic.com [online] "Acoustic Fluid Level Surveys," retrieved from URL <https://www.downholediagnostic.com/fluid-level> retrieved on Mar. 27, 2020, available on or before 2018, 13 pages.
edition.cnn.com [online], "Revolutionary gel is five times stronger than steel," retrieved from URL <https://edition.cnn.com/style/article/hydrogel-steel-japan/index.html>, retrieved on Apr. 2, 2020, available on or before Jul. 16, 2017, 6 pages.
Fjetland et al., "Kick Detection and Influx Size Estimation during Offshore Drilling Operations using Deep Learning," INSPEC 18992956, IEEE, presented at the 2019 14th IEEE Conference on Industrial Electronics and Applications (ICIEA), Jun. 19-21, 2019, 6 pages.
Gemmeke and Ruiter, "3D ultrasound computer tomography for medical imagining," Nuclear Instruments and Methods in Physics Research Section A:580 (1057-1065), Oct. 1, 2007, 9 pages.
Gil et al., "Wellbore Cooling as a Means to Permanently Increase Fracture Gradient," SPE Annual Technical Conference and Exhibition, San Antonio, Texas, Sep. 24-27, 2006, published Jan. 1, 2006, 9 pages.
Gillard et al., "A New Approach to Generating Fracture Conductivity," SPE-135034-MS, Society of Petroleum Engineers (SPE), presented at the SPE Annual Technical Conference and Exhibition held in Florence, Italy, Sep. 20-22, 2010, 13 pages.
glossary.oilfield.slb.com [online], "Underbalance," retrieved on Apr. 12, 2019, retrieved from URL http://www.glossary.oilfield.slb.com/Terms/u/underbalance.aspx, 1 pages.
Gomaa et al., "Acid Fracturing: The Effect of Formation Strength on Fracture Conductivity," SPE 119623, Society of Petroleum Engineers (SPE), presented at the SPE Hydraulic Fracturing Technology Conference, Jan. 2009, 18 pages.
Gomaa et al., "Computational Fluid Dynamics Applied to Investigate Development and Optimization of Highly Conductive Channels within the Fracture Geometry," SPE-179143-MS, Society of Petroleum Engineers (SPE), presented at the SPE Hydraulic Fracturing Technology Conference, Texas, Feb. 9-11, 2016, 18 pages.
Gomaa et al., "Improving Fracture Conductivity by Developing and Optimizing a Channels Within the Fracture Geometry: CFD Study," SPE-178982-MS, Society of Petroleum Engineers (SPE), presented at the SPE International conference on Formation Damage Control in Layfayette, Feb. 24-26, 2016, 25 pages.
gryphonoilfield.com [online], "Gryphon Oilfield Services, Echo Dissolvable Fracturing Plug," available on or before Jun. 17, 2020, retrieved on Aug. 20, 2020, retrieved from URL <https://www.gryphonoilfield.com/wp-content/uploads/2018/09/Echo-Series-Dissolvable-Fracturing-Plugs-8-23-2018-1.pdf>, 1 page.
Guilherme et al., "Petroleum well drilling monitoring through cutting image analysis and artificial intelligence techniques," Engineering Applications of Artificial Intelligence, Feb. 2011, 201-207.
halliburton.com [online], "Drill Bits and Services Solutions Catalogs," retrieved from URL: <https://www.halliburton.com/content/dam/ps/public/sdbs/sdbs_contents/Books_and_Catalogs/web/DBS-Solution.pdf> on Sep. 26, 2019, 2014, 64 pages.
Hegde et al., "Application of Real-time Video Streaming and Analytics to Breakdown Rig Connection Process," OTC-28742-MS, presented at the Offshore Technology Conference, Houston, Texas, USA, Apr. 2018, 14 pages.
Hopkin, "Factor Affecting Cuttings Removal during Rotary Drilling," Journal of Petroleum Technology 19.06, Jun. 1967, 8 pages.
hub.globalccsinstitute.com [online], "2.1 The Properties of CO2," available on or before Oct. 22, 2015, via Internet Archive: Wayback Machine URL <https://hub.globalccsinstitute.com/publications/hazard-analysis-offshore-carbon-capture-platforms-and-offshore-pipelines/21-properties-co2>, 12 pages.
Jensen, "Thermally induced hydraulic fracturing of cold water injectors," WPC-26154, World Petroleum Conference (WPC), 14th World Petroleum Congress, May 29-Jun. 1, 1994, 2 pages.
Ji et al., "Submicron Sized Nb Doped Lithium Garnet for High Ionic Conductivity Solid Electrolyte and Performance of All Solid-State Lithium Battery," doi:10.20944/preprints201912.0307.v1, Dec. 2019, 10 pages.
Johnson et al., "Advanced Deepwater Kick Detection," IADC/SPE 167990, presented at the 2014 IADC/SPE Drilling Conference and Exhibition, Mar. 4-6, 2014, 10 pages.
Johnson, "Design and Testing of a Laboratory Ultrasonic Data Acquisition System for Tomography" Thesis for the degree of Master of Science in Mining and Minerals Engineering, Virginia Polytechnic Institute and State University, Dec. 2, 2004, 108 pages.
Kern et al., "Propping Fractures with Aluminum Particles," SPE-1573-G-PA, Society of Petroleum Engineers (SPE), Journal of Petroleum Technology, Jun. 1961, 13(6): 583-589, 7 pages.
King et al., "Atomic layer deposition of TiO2 films on particles in a fluidized bed reactor," Power Technology, 183:3, Apr. 2008, 8 pages.
Koulidis et al., "Field assessment of camera based drilling dynamics," presented at the SPE Middle East Oil & Gas Show and Conference, Manama, Bahrain, Nov.-Dec. 2021, 11 pages.
Lafond et al., "Automated Influx and Loss Detection System Based on Advanced Mud Flow Modeling," SPE-195835-MS, Society of Petroleum Engineers (SPE), presented at the SPE Annual Technical Conference and Exhibition, Sep. 30-Oct. 2, 2019, 11 pages.
Li et al., 3D Printed Hybrid Electrodes for Lithium-ion Batteries, Missouri University of Science and Technology, Washington State University; ECS Transactions, 77 (11) 1209-1218 (2017), 11 pages.
Liu et al., "Flow visualization and measurement in flow field of a torque converter," Mechanic automation and control Engineering, Second International Conference on IEEE, Jul. 15, 2011, 1329-1331.
Liu et al., "Superstrong micro-grained polycrystalline diamond compact through work hardening under high pressure," Appl. Phys. Lett. Feb. 2018, 112: 6 pages.
Liu, et al "Hardness of Polycrystalline Wurtsite Boron Nitride (wBN) Compacts," Scientific Reports, Jul. 2019, 9(1):1-6, 6 pages.
Luo et al., "Simple Charts to Determine Hole Cleaning Requirements in Deviated Wells," IADC/SPE 27486, SPE/IADC Drilling Conference, Society of Petroleum Engineers, Feb. 15-18, 1994, 7 pages.
Magana-more et al., "Well control space out: a deep learning approach for the optimization of drilling safety operations," IEEE Access, 2021, 9, 14 pages.
Masa and Kuba, "Efficient use of compressed air for dry ice blasting," Journal of Cleaner Production, 111:A, Jan. 2016, 9 pages.
Maurer, "The Perfect Cleaning Theory of Rotary Drilling," Journal of Petroleum Technology 14.11, 1962, 5 pages.

(56) References Cited

OTHER PUBLICATIONS

Mayerhofer et al., "Proppants? We Don't Need No Proppants," SPE-38611, Society of Petroleum Engineers (SPE), presented at the SPE Annual Technical Conference and Exhibition, 457-464, Oct. 5, 1997, 8 pages.
Mehrad et al., "Developing a new rigorous drilling rate prediction model using a machine learning technique," Journal of Petroleum Science and Engineering, Sep. 2020, 192, 27 pages.
Meyer et al., "Theoretical Foundation and Design Formulae for Channel and Pillar Type Propped Fractures—A Method to Increase Fracture Conductivity," SPE-170781-MS, Society of Petroleum Engineers (SPE), presented at SPE Annual Technical Conference and Exhibition, Amsterdam, The Netherlands, Oct. 27-29, 2014, 25 pages.
Mueller et al., "Stimulation of Tight Gas Reservoir using coupled Hydraulic and CO2 Cold-frac Technology," SPE 160365, Society of Petroleum Engineers (SPE), presented at the SPE Asia Pacific Oil and Gas Conference and Exhibition, Oct. 22-24, 2012, 7 pages.
nature.com [online], "Mechanical Behavior of a Soft Hydrogel Reinforced with Three-Dimensional Printed Microfibre Scaffolds," retrieved from URL <https://www.nature.com/articles/s41598-018-19502-y>, retrieved on Apr. 2, 2020, available on or before Jan. 19, 2018, 47 pages.
Nuth, "Smart oil field distributed computing," The Industrial Ethernet Book, Nov. 2014, 85(14): 1-3, 3 pages.
Olver, "Compact Antenna Test Ranges," Seventh International Conference on Antennas and Propagation IEEE, Apr. 15-18, 1991, 10 pages.
Paiaman et al., "Effect of Drilling Fluid Properties on Rate Penetration," Nafta 60:3, 2009, 6 pages.
Palisch et al., "Determining Realistic Fracture Conductivity and Understanding its Impact on Well Performance—Theory and Field Examples," SPE-106301-MS, Society of Petroleum Engineers (SPE), presented at the 2007 Hydraulic Fracturing Technology Conference, College Station, Texas, Jan. 29-31, 2007, 13 pages.
Parini et al., "Chapter 3: Antenna measurements," in Theory and Practice of Modern Antenna Range Measurements, IET editorial, 2014, 30 pages.
Pavkovic et al., "Oil drilling rig diesel power-plant fuel efficiency improvement potentials through rule-based generator scheduling and utilization of battery energy storage system," Energy Conversion and Management, Science Direct, May 2016, 121: 194-211, 18 pages.
petrowiki.org [online], "Hole Cleaning," retrieved from URL <http://petrowiki.org/Hole_cleaning#Annular-fluid_velocity>, retrieved on Jan. 25, 2019, 8 pages.
petrowiki.org [online], "Kicks," Petrowiki, available on or before Jun. 26, 2015, retrieved on Jan. 24, 2018, retrieved from URL <https://petrowiki.org/Kicks>, 6 pages.
Praxair, "Carbon Dioxide, Solid or Dry Ice, Safety Data Sheet P-4575," Praxair, Jan. 1, 1997, 7 pages.
princeton.edu [online], "Bernoulli's Equation," available on or before Jul. 24, 1997, via Internet Archive: Wayback Machine URL <https://www.princeton.edu/~asmits/Bicycle_web/Bernoulli.html>, 5 pages.
Ranjbar, "Cutting Transport in Inclined and Horizontal Wellbore," University of Stavanger, Faculty of Science and Technology, Master's Thesis, Jul. 6, 2010, 137 pages.
Rasi, "Hole Cleaning in Large, High-Angle Wellbores," IADC/SPE 27464, Society of Petroleum Engineers (SPE), presented at the 1994 SPE/IADC Drilling Conference, Feb. 15-18, 1994, 12 pages.
rigzone.com [online], "How does Well Control Work?" Rigzone, available on or before 1999, retrieved on Jan. 24, 2019, retrieved from URL <https://www.rigzone.com/training/insight.asp?insight_id=304&c_id>, 5 pages.
Robinson and Morgan, "Effect of Hole Cleaning on Drilling Rate Performance," Paper Aade-04-Df-Ho-42, AADE 2004 Drilling Fluids Conference, Houston, Texas, Apr. 6-7, 2004, 7 pages.
Robinson, "Economic Consequences of Poor Solids and Control," AADE 2006 Fluids Conference and Houston, Texas, Apr. 11-12, 2006, 9 pages.
Rubaii et al., "A new robust approach for hole cleaning to improve rate of penetration," SPE 192223-MS, Society of Petroleum Engineers (SPE), presented at the SPE Kingdom of Saudi Arabia Annual Technical Symposium and Exhibition, Apr. 23-26, 2018, 40 pages.
Ruiter et al., "3D ultrasound computer tomography of the breast: A new era?" European Journal of Radiology 81S1, Sep. 2012, 2 pages.
sageoiltools.com [online] "Fluid Level & Dynamometer Instruments for Analysis due Optimization of Oil and Gas Wells," retrieved from URL <http://www.sageoiltools.com/>, retrieved on Mar. 27, 2020, available on or before 2019, 3 pages.
Schlumberger, "CERTIS: Retrievable, single-trip, production-level isolation system," www.slb.com/CERTIS, 2017, 2 pages.
Schlumberger, "First Rigless ESP Retrieval and Replacement with Slickline, Offshore Congo: Zeitecs Shuttle System Eliminates Need to Mobilize a Workover Rig," slb.com/zeitecs, 2016, 1 page.
Schlumberger, "The Lifting Business," Offshore Engineer, Mar. 2017, 1 page.
Schlumberger, "Zeitecs Shuttle System Decreases ESP Replacement Time by 87%: Customer ESP riglessly retrieved in less than 2 days on coiled tubing," slb.com/zeitecs, 2015, 1 page.
Schlumberger, "Zeitecs Shuttle System Reduces Deferred Production Even Before ESP is Commissioned, Offshore Africa: Third Party ESP developed fault during installation and was retrieved on rods, enabling operator to continue running tubing without waiting on replacement," slb.com/zeitecs, 2016, 2 pages.
Schlumberger, "Zeitecs Shuttle: Rigless ESP replacement system," Brochure, 8 pages.
Schlumberger, "Zeitecs Shuttle: Rigless ESP replacement system," Schlumberger, 2017, 2 pages.
Sifferman et al., "Drilling cutting transport in full scale vertical annuli," Journal of Petroleum Technology 26.11, 48th Annual Fall Meeting of the Society of Petroleum Engineers of AIME, Las Vegas, Sep. 30-Oct. 3, 1973, 12 pages.
Singh et al., "Introduction to an Effective Workover Method to Repair Causing Leak," SPE-194654-MS, Society of Petroleum Engineers (SPE), presented at the SPE Oil and Gas India Conference and Exhibition, Apr. 9-11, 2019, 7 pages.
slb.com [online] "Technical Paper: ESP Retrievable Technology: A Solution to Enhance ESP Production While Minimizing Costs," SPE 156189 presented in 2012, retrieved from URL <http://www.slb.com/resources/technical_papers/artificial_lift/156189.aspx>, retrieved on Nov. 2, 2018, 1 pages.
slb.com [online], "Zeitecs Shuttle Rigless ESP Replacement System," retrieved from URL <http://www.slb.com/services/production/artificial_lift/submersible/zeitecs-shuttle.aspx?t=3>, available on or before May 31, 2017, retrieved on Nov. 2, 2018, 3 pages.
Soreide et al., "Estimation of reservoir stress effects due to injection of cold fluids: an example from NCS," ARMA 14-7394, American Rock Mechanics Association, presented at the 48th US Rock mechanics/Geomechanics Symposium, Jun. 1-4, 2014, 7 pages.
Sulzer Metco, "An Introduction to Thermal Spray," 4, 2013, 24 pages.
Takahashi et al., "Degradation Study on Materials for Dissolvable Frac Plugs," URTEC-2901283-MS, Unconventional Resources Technology Conference (URTC), presented at the SPE/AAPG/SEG Unconventional Resources Technology Conference, Jul. 23-25, 2018, 9 pages.
tervesinc.com [online], "TERVALLOY™ Degradable Magnesium Alloys," available on or before Jun. 12, 2016, via Internet Archive: Wayback Machine URL <https://web.archive.org/web/20160612114602/http://tervesinc.com/media/Terves_8-Pg_Brochure.pd>, retrieved on Aug. 20, 2020, <http://tervesinc.com/media/Terves_8-Pg_Brochure.pdf>, 8 pages.
Tinsley and Williams, "A new method for providing increased fracture conductivity and improving stimulation results," SPE-4676-PA, Society of Petroleum Engineers (SPE), Journal of Petroleum Technology, 27(11): 1317-1325, 1975, 7 pages.
Tobenna, "Hole Cleaning Hydraulics," Universitetet o Stavanger, Faculty of Science and Technology, Master's Thesis, Jun. 15, 2010, 75 pages.

(56) References Cited

OTHER PUBLICATIONS

Unegbu Celestine Tobenna, "Hole Cleaning Hydraulics," Universitetet o Stavanger, Faculty of Science and Technology, Master's Thesis, Jun. 15, 2010, 75 pages.
Utkin et al., "Shock Compressibility and Spallation Strength of Cubic Modification of Polycrystalline Boron Nitride," High Temperature, 2009, 47(5):628-634, 7 pages.
Van Poollen et al., "Hydraulic Fracturing—Fracture Flow Capacity vs Well Productivity," SPE-890-G, Society of Petroleum Engineers (SPE), Petroleum Transactions AIME, 213: 91-95, 1958, 5 pages.
Van Poollen, "Productivity vs Permeability Damage in Hydraulically Produced Fractures," SPE-906-2-G, Society of Petroleum Engineers (SPE), presented at Drilling and Production Practice, New York, New York, Jan. 1957, 8 pages.
Vincent, "Examining our Assumptions—Have oversimplifications jeopardized our ability to design optimal fracture treatments," SPE-119143-MS, Society of Petroleum Engineers (SPE), presented at the SPE Hydraulic Fracturing Technology Conference, The Woodlands, Jan. 19-21, 2009, 51 pages.
Vincent, "Five Things you Didn't Want to Know about Hydraulic Fractures," ISRM-ICHF-2013-045, presented at the International Conference for Effective and Sustainable Hydraulic Fracturing, an ASRM specialized Conference, Australia, May 20-22, 2013, 14 pages.
Wastu et al., "The effect of drilling mud on hole cleaning in oil and gas industry," Journal of Physics: Conference Series, Dec. 2019, 1402:2, 7 pages.
Weatherford, "RFID Advanced Reservoir Management System Optimizes Injection Well Design, Improves Reservoir Management," Weatherford.com, 2013, 2 pages.
Wei et al., "The Fabrication of All-Solid-State Lithium-Ion Batteries via Spark Plasma Sintering," Metals, 7: 372, 2017, 9 pages.
Weinstein, "Cold Waterflooding a Warm Reservoir," SPE 5083, Society of Petroleum Engineers (SPE), presented at the 49th Annual Fall Meeting of the Society of Petroleum Engineers of AIME, Oct. 6-9, 1974, 16 pages.
Wellbore Service Tools: Retrievable tools, "RTTS Packer," Halliburton: Completion Tools, 2017, 4 pages.
wikipedia.org [online] "Optical Flowmeters," retrieved from URL <https://en.wikipedia.org/wiki/Flow_measurement#Optical_flowmeters>, retrieved on Mar. 27, 2020, available on or before Jan. 2020, 1 page.
wikipedia.org [online] "Ultrasonic Flow Meter," retrieved from URL <https://en.wikipedia.org/wiki/Ultrasonic_flow_meter>, retrieved on Mar. 27, 2020, available on or before Sep. 2019, 3 pages.
wikipedia.org [online], "Atomic layer deposition," available on or before Sep. 10, 2014, via Internet Archive: Wayback Machine URL <http://web.archive.org/web/20140910101023/http://en.wikipedia.org/wiki/Atomic_layer_deposition>, retrieved on Feb. 9, 2021, <https://en.wikipedia.org/wiki/Atomic_layer_deposition>.
wikipedia.org [online], "Chemical vapor deposition," available on or before Apr. 11, 2013, via Internet Archive: Wayback Machine URL <http://web.archive.org/web/20130411025512/http://en.wikipedia.org:80/wiki/Chemical_Vapor_Deposition>, retrieved on Feb. 9, 2021, URL <https://en.wikipedia.org/wiki/Chemical_vapor_deposition>, 12 pages.
wikipedia.org [online], "Surface roughness," retrieved from URL <https://en.wikipedia.org/wiki/Surface_roughness>, retrieved on Apr. 2, 2020, available on or before Oct. 2017, 6 pages.
Williams and Bruce, "Carrying Capacity of Drilling Muds," Journal of Petroleum Technology, 3.04, 192, 1951, 10 pages.
Williams et al., "Acidizing Fundamentals," Society of Petroleum Engineers of AIME, Jan. 1979, 131 pages.
Xia et al., "A Cutting Concentration Model of a Vertical Wellbore Annulus in Deep-water Drilling Operation and its Application," Applied Mechanics and Materials, 101-102, Sep. 27, 2011, 5 pages.
Xue et al., "Spark plasma sintering plus heat-treatment of Ta-doped Li7La3Zr2O12 solid electrolyte and its ionic conductivity," Mater. Res. Express 7 (2020) 025518, 8 pages.
Yu et al., "Chemical and Thermal Effects on Wellbore Stability of Shale Formations," SPE 71366, Society of Petroleum Engineers (SPE), presented at the 2001 SPE Annual Technical Conference and Exhibition, Sep. 30-Oct. 3, 2001, 11 pages.
Zhan et al. "Effect of β-to-α Phase Transformation on the Microstructural Development and Mechanical Properties of Fine-Grained Silicon Carbide Ceramics," Journal of the American Ceramic Society 84.5, May 2001, 6 pages.
Zhan et al. "Single-wall carbon nanotubes as attractive toughening agents in alumina-based nanocomposites," Nature Materials 2.1, Jan. 2003, 6 pages.
Zhan et al., "Atomic Layer Deposition on Bulk Quantities of Surfactant Modified Single-Walled Carbon Nanotubes," Journal of American Ceramic Society, 91:3, Mar. 2008, 5 pages.
Zhang et al, "Increasing Polypropylene High Temperature Stability by Blending Polypropylene-Bonded Hindered Phenol Antioxidant," Macromolecules, 51(5): 1927-1936, 2018, 10 pages.
Zhu et al., "Spark Plasma Sintering of Lithium Aluminum Germanium Phosphate Solid Electrolyte and its Electrochemical Properties," University of British Columbia; Nanomaterials, 9, 1086, 2019, 10 pages.

* cited by examiner

100

100

100

100

100

100

100

400a

400b

500a

500b

600

700

GAUGE CUTTER AND SAMPLER APPARATUS

TECHNICAL FIELD

This disclosure relates to a wellbore tool for gauging a wellbore and sampling solids in the wellbore.

BACKGROUND

Gauge cutters are commonly used in petroleum industry for ensuring accessibility of tubing/casing/liner prior to running any other sub-surface tools inside the well. A gauge cutter is a tool with a round, open-ended bottom which is milled to an accurate size. Large openings above the bottom of the tool allow for fluid bypass while running in the hole. Often a gauge ring will be the first tool run on a slickline operation. A gauge cutter can also be used to remove light paraffin that may have built up in the casing and drift runs also. For sampling or removing the paraffin or any other mechanical debris, formation sand, scale sand bailer is used.

SUMMARY

Certain aspects of the subject matter described can be implemented as a wellbore gauge cutter apparatus. The apparatus includes a first body. The first body defines a first opening. The first body includes a snap ring. The apparatus includes a second body. The second body includes a gauge cutter configured to dislodge solids from an inner wall of a wellbore. The snap ring of the first body is configured to hold a relative position of the second body to the first body in a closed position in response to the snap ring contacting the second body. The first body and the second body cooperatively define an inner volume. The second body defines a second opening. The apparatus includes a shear pin that passes through the second opening and extends into the first body. The shear pin is configured to hold the relative position of the second body to the first body in an open position while the shear pin is intact. The second body is configured to be able to move relative to the first body in response to the shear pin being sheared. The apparatus includes a hollow cylindrical divider disposed within the inner volume. The hollow cylindrical divider defines an inner bore. In the open position, the apparatus defines a first flow path for fluids and solids to pass through the apparatus. The first flow path is defined through the first opening, through the inner bore of the hollow cylindrical divider, and through the gauge cutter. In the open position, the apparatus defines a second flow path for fluids and solids to pass through the apparatus. The second flow path is defined through the first opening, through an annulus surrounding the hollow cylindrical divider, and through the gauge cutter. In the closed position, the second flow path is closed, such that solids remain in the annulus surrounding the hollow cylindrical divider.

This, and other aspects, can include one or more of the following features. In some implementations, the first body includes a first uphole end and a first downhole end. In some implementations, the first opening is located between the first uphole end and the first downhole end. In some implementations, the snap ring is located between the first opening and the first downhole end. In some implementations, the second body includes a second uphole end and a second downhole end. In some implementations, the second body includes an outer wall that extends from the second uphole end to the second downhole end. In some implementations, the second opening is located on and extends through the outer wall. In some implementations, the gauge cutter is located at the second downhole end. In some implementations, the snap ring has an outer profile that complements an inner profile of the second body. In some implementations, the snap ring is configured to hold the relative position of the second body to the first body in the closed position in response to the snap ring contacting the inner profile of the second body. In some implementations, the hollow cylindrical divider defines multiple apertures. In some implementations, the first body includes a connector head located at the first uphole end. In some implementations, the connector head is configured to interface with a sucker rod or wireline. In some implementations, the first body includes a magnet. In some implementations, the magnet is disposed on an outer surface of the first body. In some implementations, the apparatus includes a sensor unit. In some implementations, the sensor unit includes a casing-collar locator, an inclination sensor, a pressure sensor, a temperature sensor, or any combination of these.

Certain aspects of the subject matter described can be implemented as an apparatus. The apparatus includes a first body, a second body, a shear pin, and a divider. The first body includes a coupling. The second body includes a cutter blade. The coupling is separated from contact with the second body in an open position. The coupling is configured to couple the first body to the second body in a closed position in response to the coupling contacting the second body. The first body and the second body cooperatively define an inner volume. The shear pin extends from the second body and into the first body. The shear pin is configured to hold the position of the second body relative to the first body in the open position while the shear pin is intact. The second body is configured to be able to move relative to the first body in response to the shear pin being sheared. The divider is disposed within the inner volume. The divider defines an inner bore. In the open position, the apparatus defines first and second flow paths for fluids and solids to pass through the apparatus. The first flow path is defined through the first body and through the inner bore of the divider. The second flow path is defined through the first body and through an annulus surrounding the divider. In the closed position, the second flow path is closed, such that solids remain in the annulus surrounding the divider.

This, and other aspects, can include one or more of the following features. In some implementations, the divider is threadedly coupled to the first body. In some implementations, the cutter blade is a gauge cutter configured to dislodge solids from an inner wall of a wellbore. In some implementations, the coupling includes a snap ring that has an outer profile that complements an inner profile of the second body. In some implementations, the divider is cylindrical and defines multiple apertures. In some implementations, the first body includes a connector head configured to interface with a sucker rod or wireline. In some implementations, the first body includes a magnet disposed on an outer surface of the first body. In some implementations, the apparatus includes a sensor unit that includes a casing-collar locator, an inclination sensor, a pressure sensor, a temperature sensor, or any combination of these.

Certain aspects of the subject matter described can be implemented as a method. The method is implemented by a gauge cutter apparatus that includes a first body, a second body, a shear pin, and a divider. The first body includes a snap ring. The second body includes a gauge cutter. The first body and the second body define an inner volume. The divider is disposed within the inner volume. The inner volume is separated by the divider into a first flow path through the apparatus and a second flow path through the apparatus. The first flow path is defined through an inner bore of the divider. The second flow path is defined through an annulus surrounding the divider. The second body is coupled to the first body by the shear pin, thereby securing a position of the second body relative to the first body in an open position. During a downhole motion of the apparatus through a tubing in a wellbore, a material is cut by the gauge cutter from an inner wall of the tubing, such that the material is released from the inner wall of the tubing. In response to the gauge cutter cutting the material from the inner wall of the tubing, the shear pin is sheared, thereby allowing the second body to move relative to the first body. During the downhole motion of the apparatus through the tubing, the second body is contacted by the snap ring. In response to the snap ring contacting the second body, the position of the second body relative to the first body is secured in a closed position, thereby closing the second flow path, such that the second flow path ends with the annulus surrounding the divider. During an uphole motion of the apparatus through the tubing, the material is separated by the divider into the first flow path through the apparatus and the closed second flow path into the annulus surrounding the divider. A sample of the material is collected in the annulus surrounding the divider.

This, and other aspects can include one or more of the following features. In some implementations, the first body is disconnected from the second body to access the collected sample. In some implementations, the collected sample is analyzed using an x-ray diffraction test, an acid test, or any combination of these.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

The wellbore gauge cutter apparatus may be used in wellbores to dislodge, scrape, or clean debris from the inner walls of a wellbore casing, or other tubular structure in the wellbore. The apparatus includes a sampling body with sampling collectors or screens that are permeable to fluids. The sampling collectors retain a portion of the particles suspended in the fluid for later analysis at the surface. In use, the apparatus undergoes a running-in-hole (RIH) operation to dislodge debris from an inner wall of the casing. The debris, for example, in the form of particles, is suspended in a fluid in the casing. The apparatus then undergoes a pulling out of hole (POOH) operation in which a portion of the fluid in the casing flows through the gauge cutter apparatus. Another portion of the fluid with suspended particles in the casing flows into the apparatus, and the particles remained trapped within the gauge cutter apparatus. At the surface, the apparatus can be opened to access the collected sample for further analysis.

The apparatus samples the debris dislodged by the apparatus in a single trip. The apparatus may increase the speed of cutting and debris sampling and may reduce errors by eliminating the need to switch tools between runs. Further, the apparatus protects the collected sample during cutting and transportation to the surface, so that the samples may be accurately analyzed. Analyzing the sample can also determine the chemical compositions and natures of the particles. A fit-for-purpose removal well intervention can be designed around the chemical composition and, if applicable, the positions of the particles relative to the wellbore.

Figure 1A:
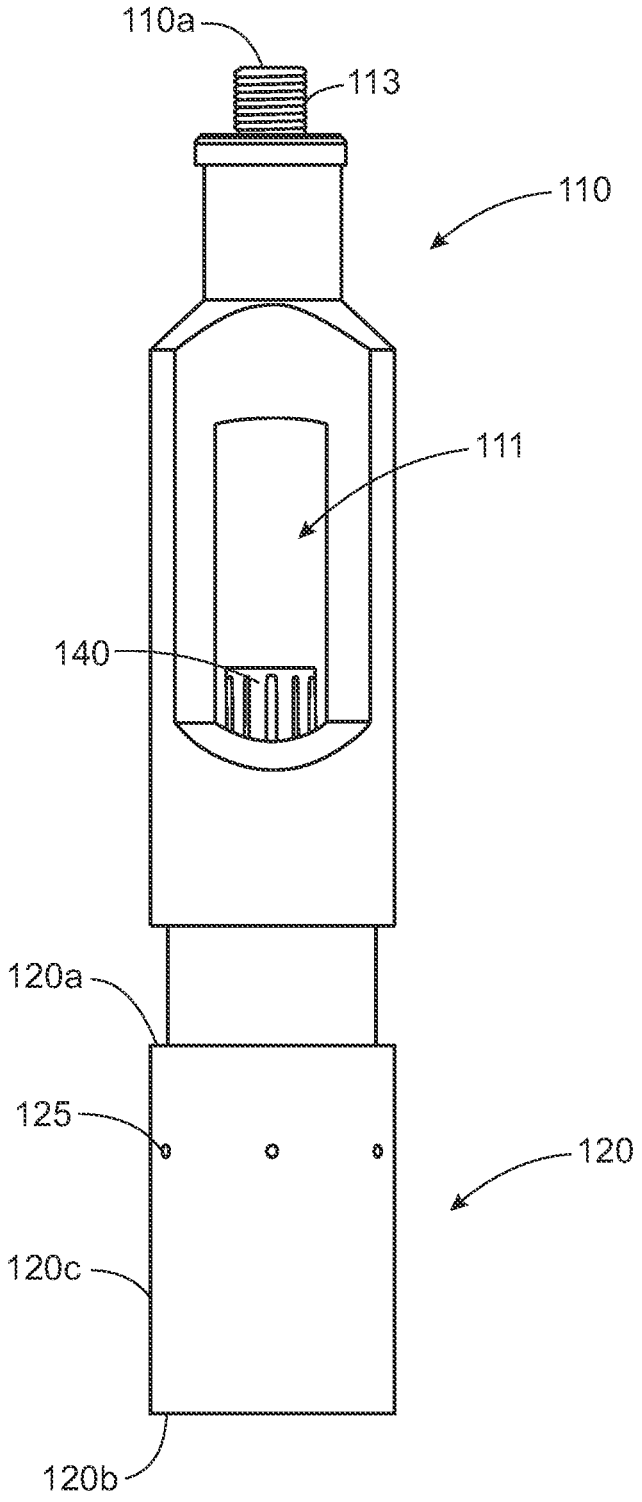
FIG. 1A is a front view of an example apparatus for sampling material that has been dislodged from a wall of a wellbore formed in a subterranean formation.
Figure 1B:
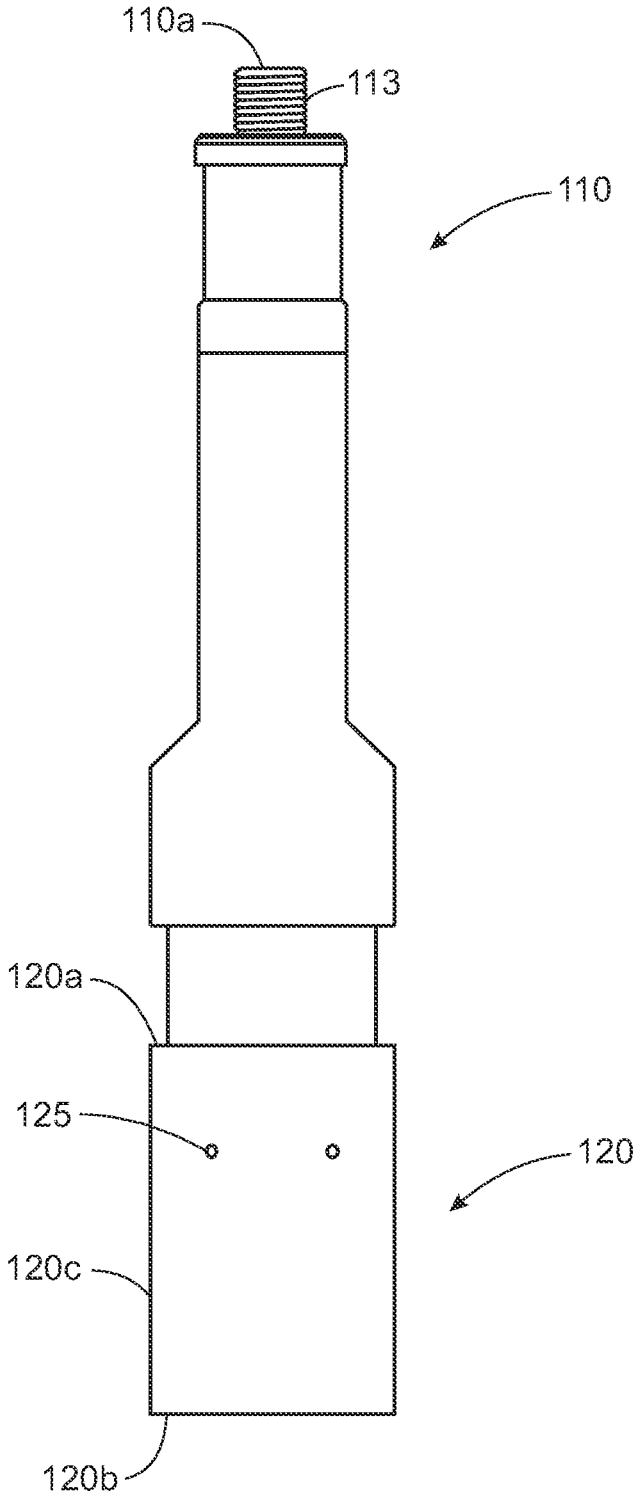
FIG. 1B is a side view of the apparatus of FIG. 1A.
Figure 1C:
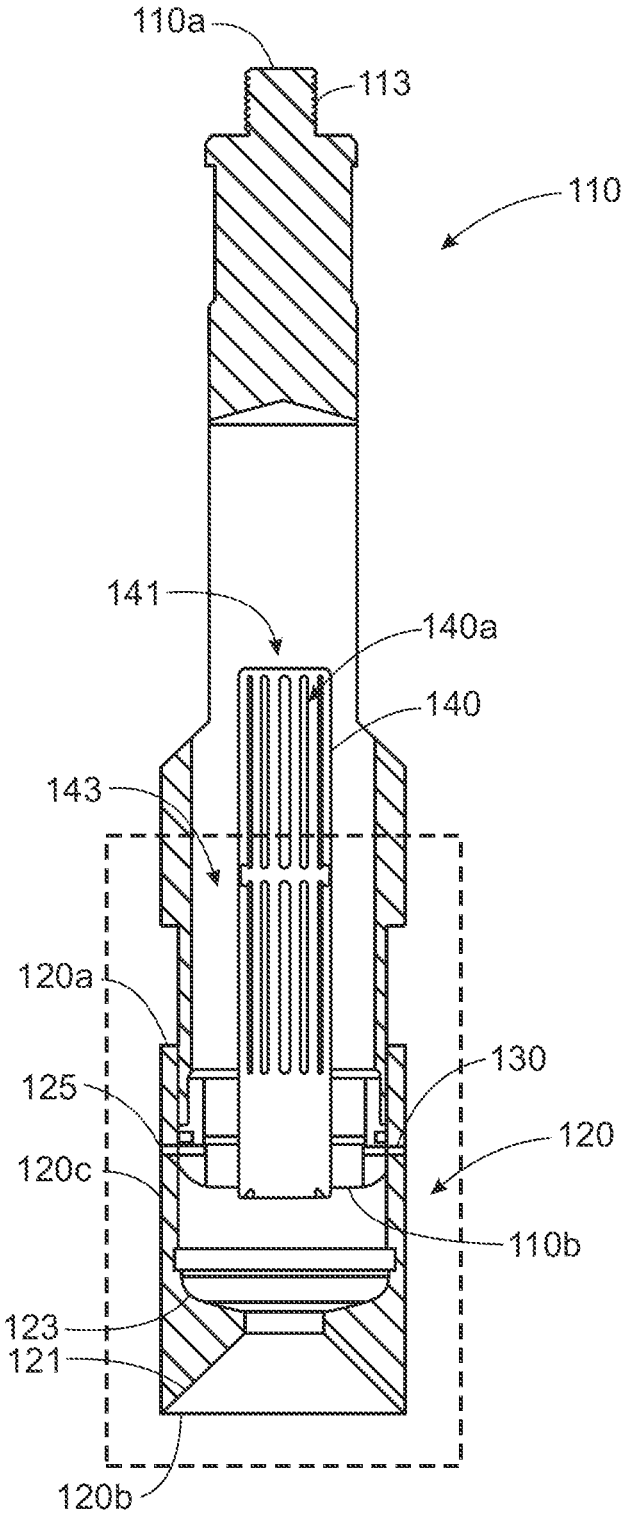
FIG. 1C is a side view that shows inner components of the apparatus of FIG. 1A.

FIG. 1A is a front view of an example apparatus 100 for sampling material that has been dislodged from a wall of a wellbore formed in a subterranean formation. FIG. 1B is a side view of the apparatus 100, and FIG. 1C is a side view showing inner components of the apparatus 100. The apparatus 100 includes a first body 110, a second body 120, a shear pin 130, and a divider 140. As shown in FIG. 1C, the shear pin 130 extends from the second body 120 and into the first body 110. While intact, the shear pin 130 is configured to hold the position of the second body 120 relative to the first body 110 in an open position. Therefore, while intact, the shear pin 130 serves as a first coupling that couples the first body 110 and the second body 120 together in the open position. In response to the shear pin 130 being sheared, the second body 120 is configured to be able to move relative to the first body 110. For example, once the shear pin 130 has been sheared, the second body 120 can slide longitudinally in relation to the first body 110. The first body 110 includes a second coupling 123. In some implementations, the second coupling 123 is a snap ring.

The second body 120 includes a cutter blade 121. In the open position (while the shear pin 130 is intact), the second coupling 123 is separated from contact with the second body 120. Once the shear pin 130 has been sheared, the apparatus 100 is referred to as being 'activated'. Once the apparatus 100 has been activated, the second body 120 is free to move relative to the first body 110. In response to contacting the second body 120, the second coupling 123 is configured to couple the first body 110 to the second body 120 in a closed position. If the second body 120 moves close enough to the first body 110, such that the second coupling 123 of the first body 110 contacts the second body 120, the second coupling 123 snaps to the second body 120 and holds the position of the second body 120 relative to the first body 110 in the closed position. For example, after the shear pin 130 has been sheared, the second body 120 can slide longitudinally toward the first body 110, and once the second coupling 123 contacts the second body 120, the second coupling 123 couples the first body 110 and the second body 120 together in the closed position.

The first body 110 and the second body 120 cooperatively define an inner volume. The divider 140 is disposed within the inner volume. The divider 140 defines an inner bore 141. In the open position, the apparatus 100 defines a first flow path for fluids and solids to pass through the apparatus 100 and a second flow path for fluids and solids to pass through the apparatus 100. The solids can be, for example, solids that have been dislodged by the cutter blade 121 from an inner wall of a wellbore while the apparatus 100 travels through the wellbore. The first flow path is defined through the first body 110 and through the inner bore 141 of the divider 140. The second flow path is defined through the first body 110 and through an annulus 143 surrounding the divider 140. In the open position, both the first flow path and the second flow path are open, such that fluids and solids can pass through the apparatus 100. In the closed position, an end of the second flow path is obstructed by the second body 120 being coupled to the first body 110 by the second coupling 123, thereby closing the second flow path. In the closed position, solids that flow into the annulus 143 remain in the annulus 143. Therefore, in the closed position, the annulus 143 serves as a sampling volume for the apparatus 100.

The cutter blade 121 can have a hollow frustoconical shape, such that fluids and solids can flow through it. In some implementations, the cutter blade 121 is a gauge cutter that is configured to dislodge solids from an inner wall of a wellbore (for example, an inner wall of a tubing disposed in the wellbore). An end of the cutter blade 121 scrapes, cuts, or scours the inner wall of the wellbore as the apparatus 100 travels through the wellbore. In some implementations, the cutter blade 121 is integrally formed with the second body 120. In some implementations, the cutter blade 121 is connected to the second body 120 (for example, by mounting or releasable attachment). In some implementations, the cutter blade 121 is detachable from the second body 120 and replaceable by a different cutter blade. In such implementations, the connection between the cutter blade 121 and the second body 120 can be a snap fit connection, magnetic connection, bolted connection, tongue and groove connection, or any other mechanical connection known in the art. As shown in FIG. 1C, the cutter blade 121 has the same shape and size as the second body 120, such that both are cylindrically shaped and have the same diameter. In some implementations, the cutter blade 121 is shaped differently from the second body 120. For example, the cutter blade 121 may have a larger diameter and/or may mirror the shape of a wellbore tubing to form a close fit with the tubing. Such an embodiment is described in further detail with reference to FIG. 5B.

The first body 110 can have an uphole end 110*a* and a downhole end 110*b*. In some implementations, the first body 110 defines an opening 111 located between the uphole end 110*a* and the downhole end 110*b*. In some implementations, the first body 110 includes a connector head 113 located at the uphole end 110*a*. The connector head 113 can be configured to interface with a sucker rod, coiled tubing, or a wireline (for example, an electric line, a braided line, or a slickline). In some implementations, the second coupling 123 is located between the opening 111 and the downhole end 110*b*. The second body 120 can have an uphole end 120*a* and a downhole end 120*b*. The second body 120 can have an outer wall 120*c* that extends from the uphole end 120*a* to the downhole end 120*b*. The downhole end 120*b* of the second body 120 can be an open end. Therefore, in some implementations, the inner volume is open to the environment in which the apparatus 100 is located (for example, downhole within a wellbore) via the opening 111 of the first body 110 and the downhole end 120*b* of the second body 120. In some implementations, the cutter blade 121 is located at the downhole end 120*b* of the second body 120. In some implementations, the second coupling 123 is a snap ring that has an outer profile that complements an inner profile of the second body 120. In some implementations, the second body 120 defines an opening 125 located on and extending through the outer wall 120*c*. In some implementations, the shear pin 130 passes through the opening 125 and extends into the first body 110.

In some implementations, the divider 140 is a hollow cylindrical divider. In some implementations, the divider 140 is threadedly coupled to the first body 110. In some implementations, the first flow path is defined through the opening 111, through the inner bore 141 of the divider 140, and through the cutter blade 121. In some implementations, the second flow path is defined through the opening 111, through the annulus 143, and through the cutter blade 121. In the closed position, an end of the second flow path is closed, such that fluids and solids cannot flow into or out of the second flow path through the cutter blade 121. For example, the second body 120 being coupled to the first body 110 by the second coupling 123 closes off communication between the annulus 143 and the cutter blade 121. In some implementations, the divider 140 is permeable to fluids and configured to filter solids of smaller than a predetermined size. For example, the divider 140 can be or include a screen, a permeable partition, a flexible membrane, a rigid membrane, a filter, a fabric mesh, a wire mesh, or any combination of these. For example, the divider 140 can define multiple apertures 140*a*. The apertures 140*a* are open spaces through which fluid and solids of smaller than a predetermined size may flow. In some implementations, a width of each of the apertures 140*a* is in a range of from about 0.1 millimeters (mm) to about 15 mm or from about 0.5 mm to about 10 mm. The width of the apertures 140*a* can be adjusted to account for larger or smaller solid sizes. The apertures 140*a* can have a circular shape, a slot/rectangular shape, or any other shape. In some implementations, the apertures 140*a* have the same shape. In some implementations, the shapes of the apertures 140*a* vary. The divider 140 can be entirely rigid, entirely flexible, or both rigid and flexible, for example, at different portions of the divider 140. In some implementations, the divider 140 is made of an elastic, stretchable material. In some implementations, the divider 140 is made of plastic, metal, fabric, polymer, elastomer, or any combination of these.

Figure 2A:
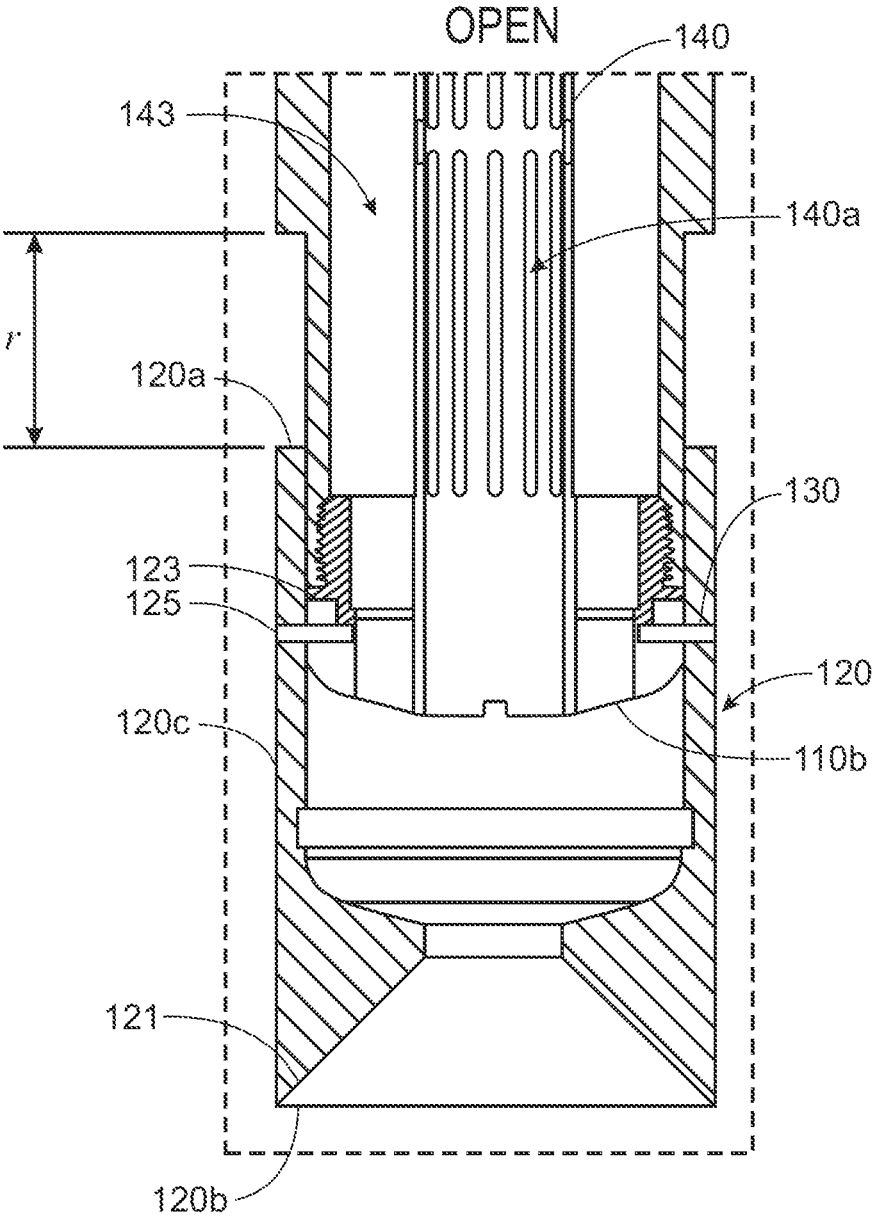
FIG. 2A is an enlarged side view showing the inner components of the apparatus of FIG. 1A in an open position.
Figure 2B:
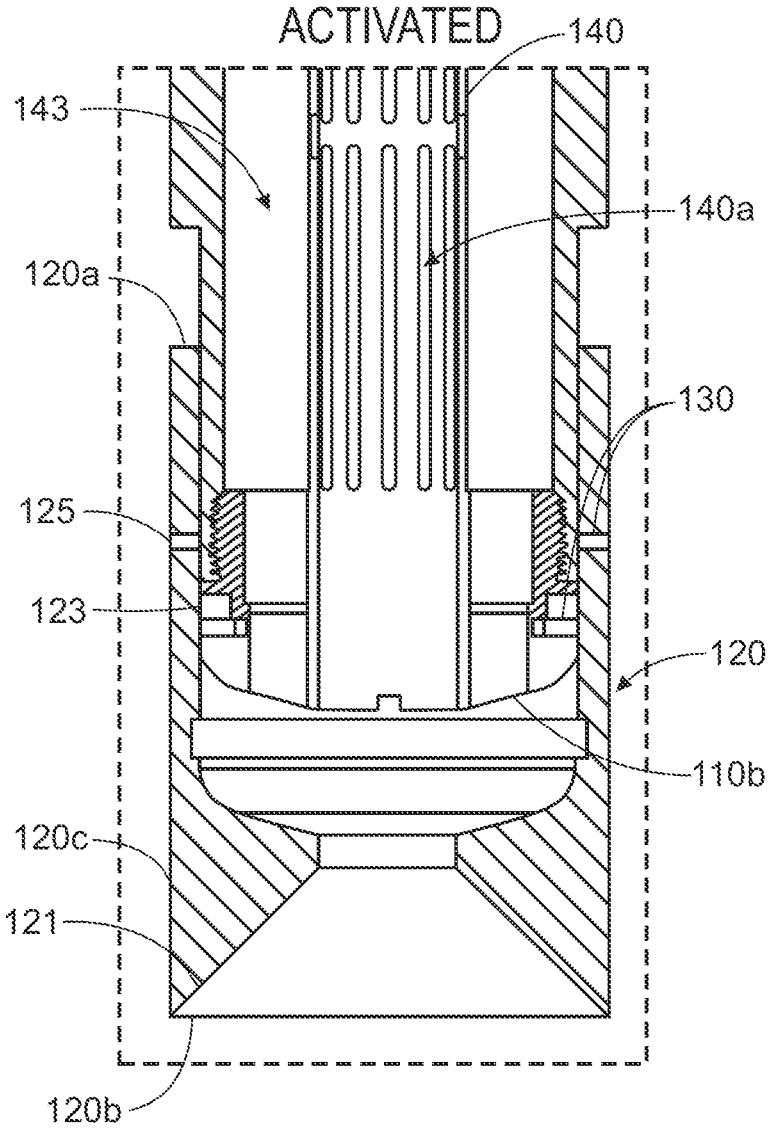
FIG. 2B is an enlarged side view showing the inner components of the apparatus of FIG. 1A once it has been activated.
Figure 2C:
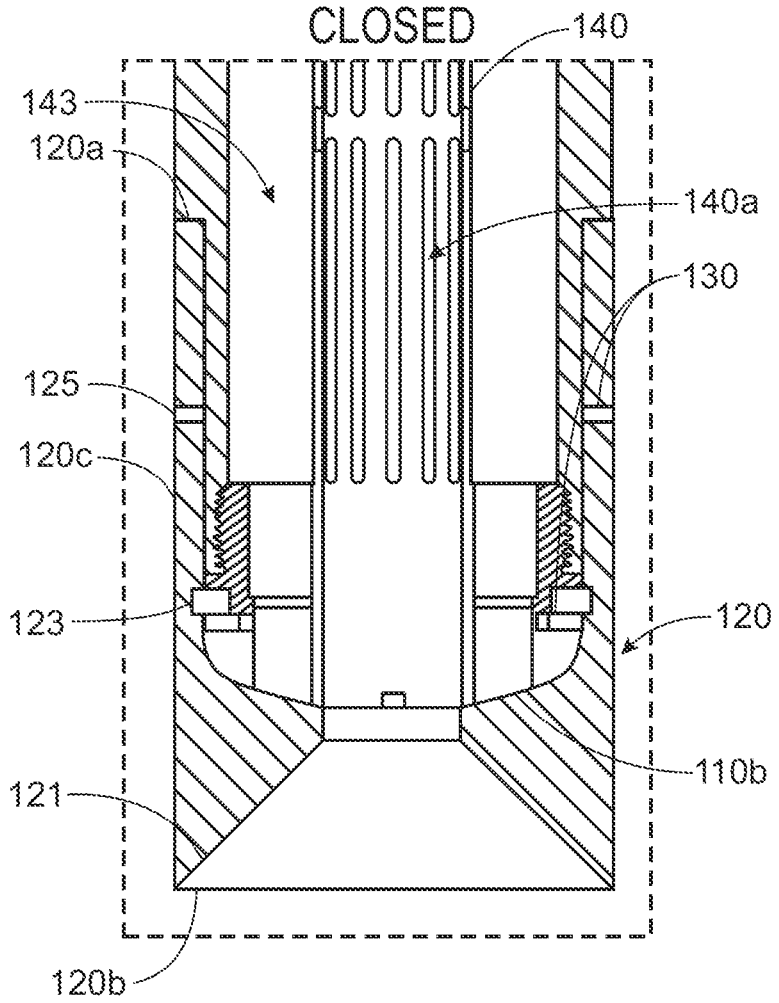
FIG. 2C is an enlarged cross-sectional view showing the inner components of the apparatus of FIG. 1A in a closed position.

FIGS. 2A, 2B, and 2C are enlarged views of dotted region 100*a* of FIG. 1C, showing the inner components of the apparatus 100 in operation. FIG. 2A is an enlarged side view showing the inner components of the apparatus 100 in the open position. As shown in FIG. 2A, the shear pin 130 is intact and holds the position of the second body 120 relative to the first body 110 in the open position. In the open position, fluids and solids can flow through the first flow path and the second flow path through the apparatus 100. FIG. 2B is an enlarged side view showing the inner components of the apparatus 100 once it has been activated. In FIG. 2B, the shear pin 130 has been sheared, such that a first portion of the shear pin 130 is disconnected from a second portion of the shear pin 130. The shear pin 130 can be sheared by a force imparted on the second body 120, for example, a force on the cutter blade 121 that pushes the second body 120 in a direction toward the first body 110 (for example, uphole direction). The first portion of the shear pin 130 can remain with the first body 110, and the second portion of the shear pin 130 can remain in the opening 125 of the second body 120. Once the shear pin 130 has been sheared, the second body 120 is free to move relative to the first body 110. For example, the shapes of the first body 110 and the second body 120 allow for the second body 120 to slide longitudinally relative to the first body 110 once the apparatus 100 has been activated.

FIG. 2C is an enlarged cross-sectional view showing the inner components of the apparatus 100 in the closed position. Once the second coupling 123 contacts the second body 120, the second coupling 123 couples the second body 120 to the first body 110 and holds the position of the second body 120 relative to the first body 110. In the closed position, the second coupling 123 prevents movement of the second body 120 relative to the first body 110. For example, in the closed position, the second coupling 123 prevents the second body 120 from sliding longitudinally relative to the first body 110. In the closed position, the second body 120 being coupled to the first body 110 by the second coupling 123 closes the second flow path. Therefore, in the closed position, the first flow path remains open, while the second flow path is closed. In the closed position, fluids and solids can flow through the first flow path, and at least a portion of the solids that flow into the annulus 143 of the second flow path remain in the annulus 143 (sampling volume). In sum, the apparatus 100 is configured to begin accumulating solid samples once it is in the closed position. Thus, the apparatus 100 can selectively collect solid samples at or near the locale at which the cutter blade 121 has dislodged debris from the inner wall of the wellbore.

For example, solids that are sufficiently large for conducting analysis may remain in the annulus 143, while solids that are too small for conducting analysis may pass through the apparatus 100. For example, solids with a maximum dimension that is greater than about 10 mm or greater than about 15 mm that flow into the annulus 143 may remain in the annulus 143, while solids with a maximum dimension that is less than about 10 mm or less than about 15 mm may flow out of the annulus 143, through the apertures 140*a* of the divider 140, into the first flow path, and out of the apparatus 100. In some implementations, the apparatus 100 includes a stop that prevents the second body 120 from moving longitudinally away from the first body 110 past the original position of the second body 120 relative to the first body 110 when the shear pin 130 was intact. In such implementations, once the apparatus 100 is activated and between the open and closed positions, the second body 120 is free to slide longitudinally relative to the first body 110 across the range r labeled in FIG. 2A.

Figure 3A:
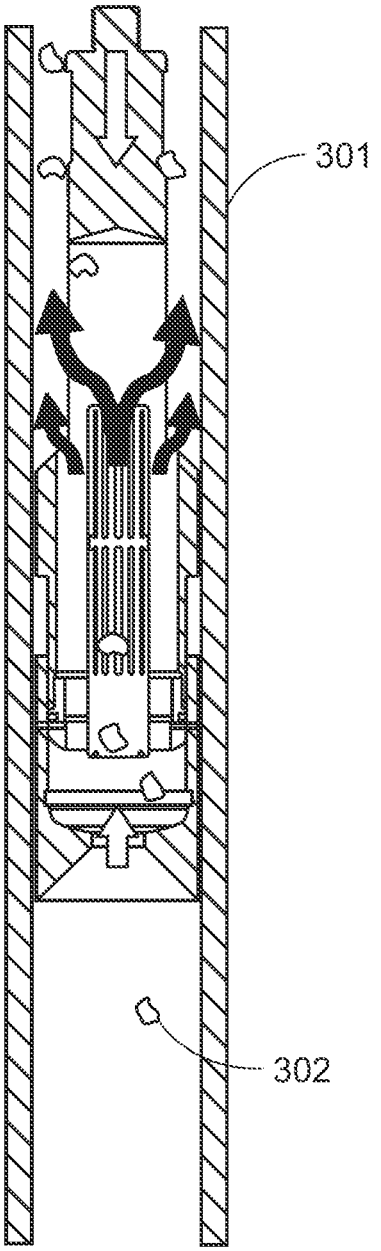
FIG. 3A is a side view showing the inner components of the apparatus of FIG. 1A in the open position traveling through a tubing in a first direction.
Figure 3B:
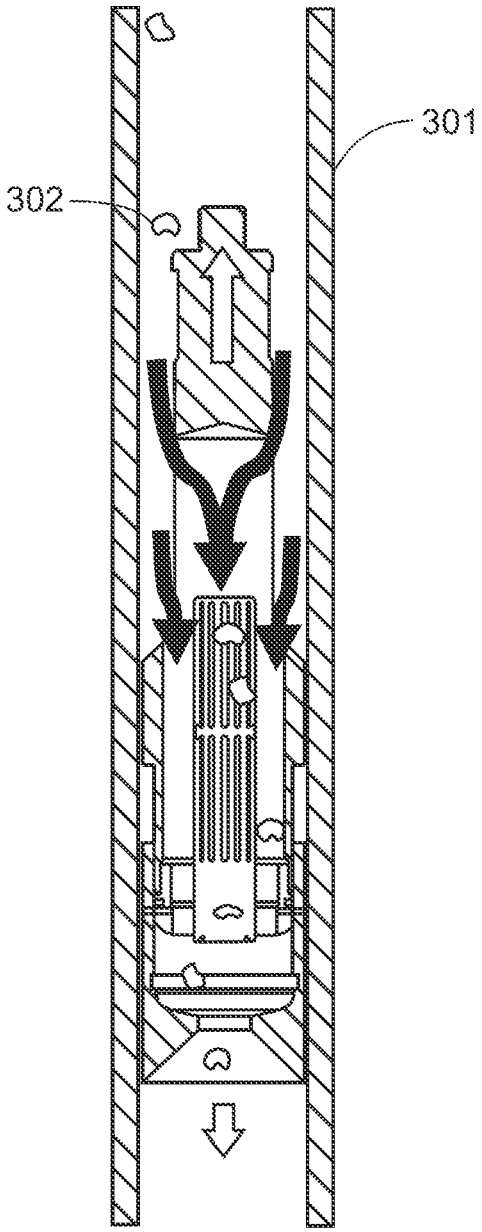
FIG. 3B is a side view showing the inner components of the apparatus of FIG. 1A in the open position traveling through a tubing in a second direction.

FIGS. 3A and 3B are side views showing the inner components of the apparatus 100 in operation while in the open position. As mentioned previously, the shear pin 130 is intact while the apparatus 100 is in the open position, and the first flow path (through inner bore 141 of divider 140) and the second flow path (through annulus 143 surrounding divider 140) defined by the apparatus 100 are open. In FIG. 3A, the apparatus 100 is traveling through a tubing 301 in a first direction, for example, the downhole direction. The apparatus 100 is moved downhole, for example, by extension of a slickline, during a run in hole (RIH) operation. As the apparatus 100 travels downhole through the tubing 301, the cutter blade 121 cuts debris 302 from an inner wall 301*a* of the tubing 301. The dislodged debris 302 is suspended in the fluid in the tubing 301. The fluid and debris 302 move uphole relative to the apparatus 100 moving downhole. The debris 302 are not collected in the sampling volume (annulus 143) as the apparatus 100 moves downhole while in the open position. The fluid and debris 302 can enter the apparatus 100 via the downhole end 120*b* of the second body 120 (cutter blade 121). A first portion of the fluid and debris 302 can flow through the apparatus 100 via the first flow path (through the inner bore 141 of the divider 140). A second portion of the fluid and debris 302 can flow through the apparatus 100 via the second flow path (through the annulus 143 surrounding the divider 140). The fluid and debris 302 can exit the apparatus 100 via the opening 111 of the first body 110. In some cases, a portion of the fluid and debris flowing through the first flow path can flow out of the first flow path and into the second flow path (from the inner bore 141 and into the annulus 143) via the apertures 140*a* of the divider 140 before flowing out of the apparatus 100, for example, via the opening 111. In some cases, the fluid and debris flowing through the second flow path can flow out of the second flow path and into the first flow path (from the annulus 143 and into the inner bore 141) via the apertures 140*a* of the divider 140 before flowing out of the apparatus 100, for example, via the opening 111.

In FIG. 3B, the apparatus 100 is traveling through the tubing 301 in a second direction, for example, the uphole direction. The apparatus 100 is moved uphole, for example, by retraction of the slickline, during a pull out of hole (POOH) operation. The fluid and debris 302 move downhole relative to the apparatus 100 moving uphole. The fluid and debris 302 can enter the apparatus 100 via the opening 111 of the first body 110. A first portion of the fluid and debris 302 can flow through the apparatus 100 via the first flow path (through the inner bore 141 of the divider 140). A second portion of the fluid and debris 302 can flow through the apparatus 100 via the second flow path (through the annulus 143 surrounding the divider 140). The fluid and debris 302 can exit the apparatus 100 via the downhole end 120*b* of the second body 120 (cutter blade 121). In some cases, a portion of the fluid and debris flowing through the first flow path can flow out of the first flow path and into the second flow path (from the inner bore 141 and into the annulus 143) via the apertures 140*a* of the divider 140 before flowing out of the apparatus 100, for example, via the downhole end 120*b* of the second body 120. In some cases, a portion of the fluid and debris flowing through the second flow path can flow out of the second flow path and into the first flow path (from the annulus 143 and into the inner bore 141) via the apertures 140*a* of the divider 140 before flowing out of the apparatus 100, for example, via the downhole end 120*b* of the second body 120.

Figure 3C:
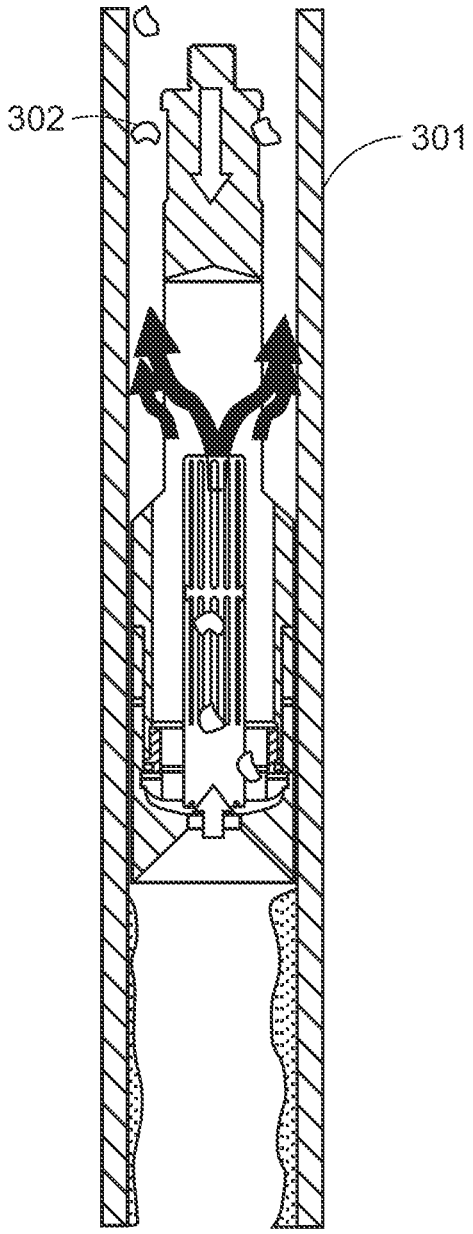
FIG. 3C is a side view showing the inner components of the apparatus of FIG. 1A in the closed position traveling through a tubing in the first direction.
Figure 3D:
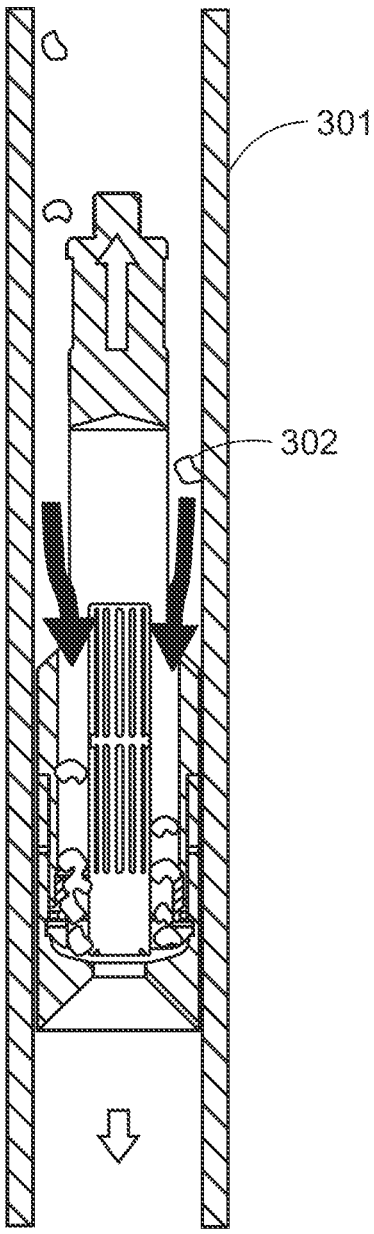
FIG. 3D is a side view showing the inner components of the apparatus of FIG. 1A in the closed position traveling through a tubing in the second direction.

FIGS. 3C and 3D are side views showing the inner components of the apparatus 100 in operation while in the closed position. As mentioned previously, the shear pin 130 is sheared and the second coupling 123 holds the position of the second body 120 relative to the first body 110 in the closed position. While the apparatus 100 is in the closed position, the first flow path (through inner bore 141 of divider 140) is open, and the second flow path (through annulus 143 surrounding divider 140) is closed. In FIG. 3C, the apparatus 100 is traveling through the tubing 301 in the first direction, for example, the downhole direction. The apparatus 100 is moved downhole, for example, by extension of a slickline, during an RIH operation. As the apparatus 100 travels downhole through the tubing 301, the cutter blade 121 cuts debris 302 from an inner wall 301*a* of the tubing 301. The dislodged debris 302 is suspended in the fluid in the tubing 301. The fluid and debris 302 move uphole relative to the apparatus 100 moving downhole. The debris 302 can be collected in the sampling volume (annulus 143) as the apparatus 100 moves downhole while in the closed position, for example, due to gravity. The fluid and debris 302 can enter the apparatus 100 via the downhole end 120*b* of the second body 120 (cutter blade 121). The fluid and debris 302 can flow through the apparatus 100 via the first flow path (through the inner bore 141 of the divider 140). The fluid and some or all of the debris 302 can exit the apparatus 100 via the opening 111 of the first body 110. In some cases, a portion of the fluid and debris flowing through the first flow path can flow out of the first flow path and into the second flow path (from the inner bore 141 and into the annulus 143) via the apertures 140*a* of the divider 140. In some cases, some or all of the debris that flows into the annulus 143 may remain within the annulus 143, for example, if the debris is heavy enough to remain settled in the annulus 143. Otherwise, the debris may flow uphole relative to the apparatus 100 as the apparatus 100 travels in the downhole direction.

In FIG. 3D, the apparatus 100 is traveling through the tubing 301 in the second direction, for example, the uphole direction. The apparatus 100 is moved uphole, for example, by retraction of the slickline, during a POOH operation. The fluid and debris 302 move downhole relative to the apparatus 100 moving uphole. The fluid and debris 302 can enter the apparatus 100 via the opening 111 of the first body 110. A first portion of the fluid and debris 302 can flow through the apparatus 100 via the first flow path (through the inner bore 141 of the divider 140). The first portion of the fluid and debris 302 can exit the apparatus 100 via the downhole end 120*b* of the second body 120 (cutter blade 121). A second portion of the fluid and debris 302 can flow into the sampling volume (annulus 143) the apparatus 100 via the second flow path (through the annulus 143 surrounding the divider 140). In some cases, a portion of the fluid and debris flowing through the first flow path can flow out of the first flow path and into the second flow path (from the inner bore 141 and into the annulus 143) via the apertures 140*a* of the divider 140. In some cases, a portion of the fluid and debris flowing through the second flow path can flow out of the second flow path and into the first flow path (from the annulus 143 and into the inner bore 141) via the apertures 140*a* of the divider 140 before flowing out of the apparatus 100, for example, via the downhole end 120*b* of the second body 120. The debris retained in the annulus 143 can be analyzed, for example, once the apparatus 100 has been pulled to the surface. Analysis of the debris collected in the sampling volume of the apparatus 100 (annulus 143) can include X-ray diffraction (XRD) and/or an acid test. In some implementations, the annulus 143 (sampling volume) can retain at least 50 grams or at least 100 grams of solids in the closed position. In some implementations, the annulus 143 (sampling volume) can retain from about 50 grams to about 1000 grams of solids in the closed position. In some implementations, the annulus 143 (sampling volume) can retain more than 1000 grams of solids in the closed position (see, for example, FIG. 4B and accompanying text). The solids may include wax particles, formation fine particles, scale particles (for example, calcium carbonate, sodium chloride, barium sulfate, strontium sulfate, and iron sulfide), corrosion particles, metal particles, or any combination of these.

Figure 4A:
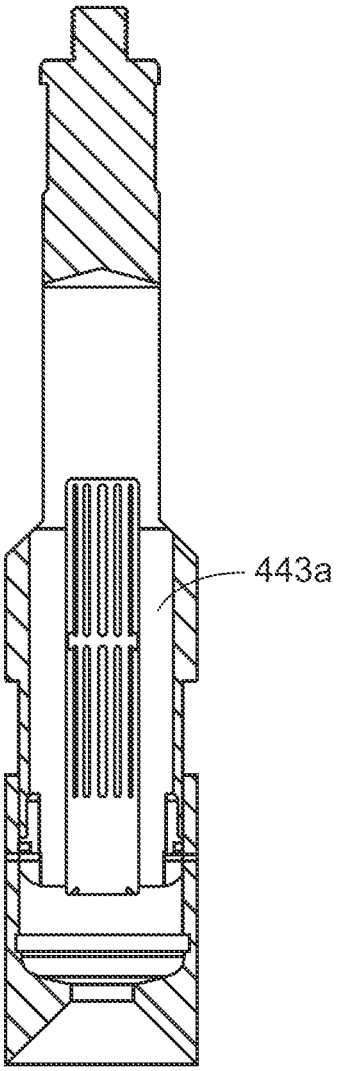
FIG. 4A is a side view showing inner components of an example apparatus for sampling material that has been dislodged from a wall of a wellbore formed in a subterranean formation.
Figure 4B:
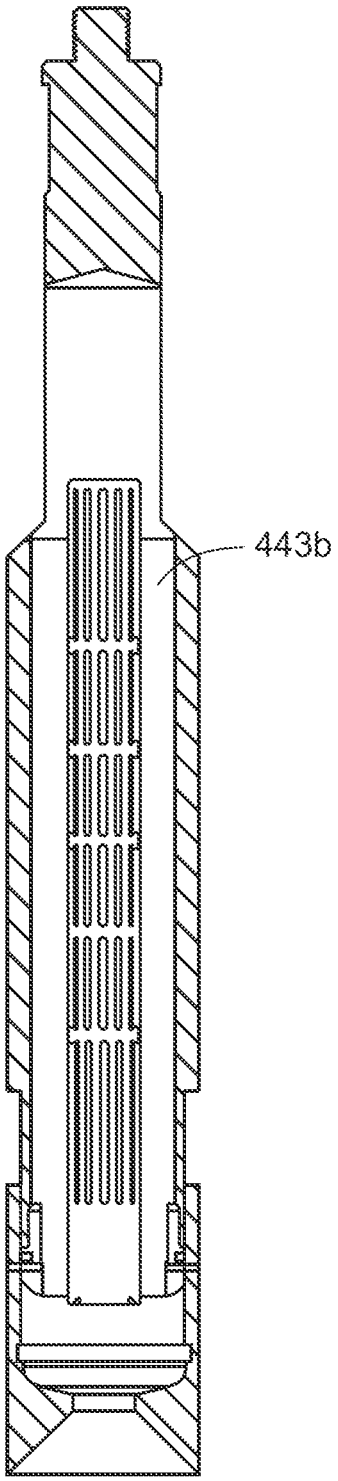
FIG. 4B is a side view showing inner components of an example apparatus for sampling material that has been dislodged from a wall of a wellbore formed in a subterranean formation. The apparatus of FIG. 4B has a larger sampling volume in comparison to the apparatus of FIG. 4A.

The sampling volume (volume of annulus 143) can be adjusted by increasing dimension(s) (for example, longitudinal length and/or diameter) of the first body 110, the second body 120, or both the first body 110 and the second body 120. In some implementations, the longitudinal length of the divider 140 is also increased. In some implementations, the diameter of the divider 140 is decreased. In some implementations, the volume of the annulus 143 (sampling volume) is at least about 0.3 liters (L) or at least about 0.5 liters. In some implementations, the volume of the annulus 143 (sampling volume) is in a range of from about 0.1 L to about 1.5 L, a range of from about 0.3 L to about 1 L, or a range of from about 0.5 L to about 0.75 L. In some implementations, the volume of the annulus 143 (sampling volume) is greater than 1.5 L (see, for example, FIG. 4B and accompanying text). FIGS. 4A and 4B are side views showing inner components of example apparatuses 400*a* and 400*b*, respectively, for sampling material that has been dislodged from a wall of a wellbore formed in a subterranean formation. The apparatuses 400*a* and 400*b* can be substantially similar to the apparatus 100. The apparatuses 400*a* and 400*b* are substantially similar but have different sampling volumes. The annulus 443*b* surrounding the divider 440*b* of apparatus 400*b* has a larger volume in comparison to the annulus 443*a* surrounding the divider 440*a* of apparatus 400*a*. Therefore, the apparatus 400*b* has a larger sampling volume in comparison to the apparatus 400*a*.

Figure 5A:
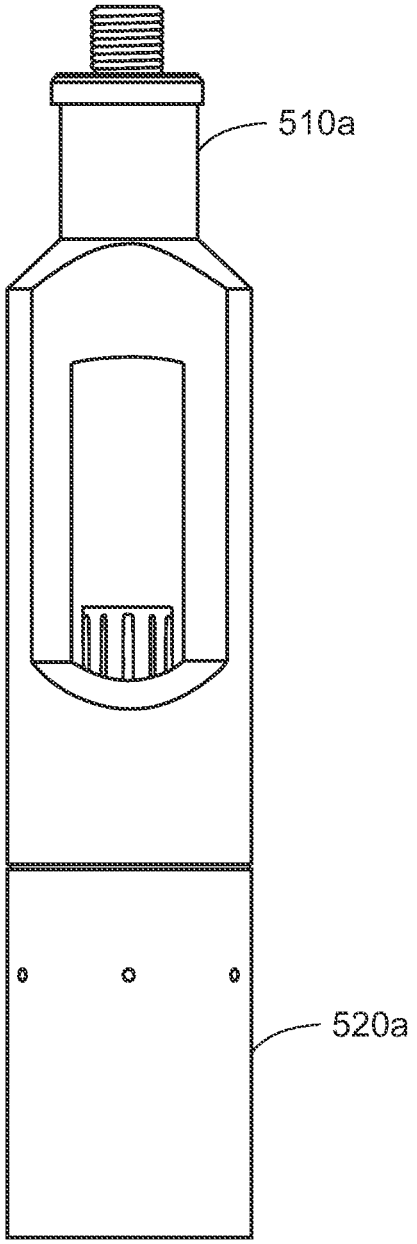
FIG. 5A is a front view of an example apparatus for sampling material that has been dislodged from a wall of a wellbore formed in a subterranean formation.
Figure 5B:
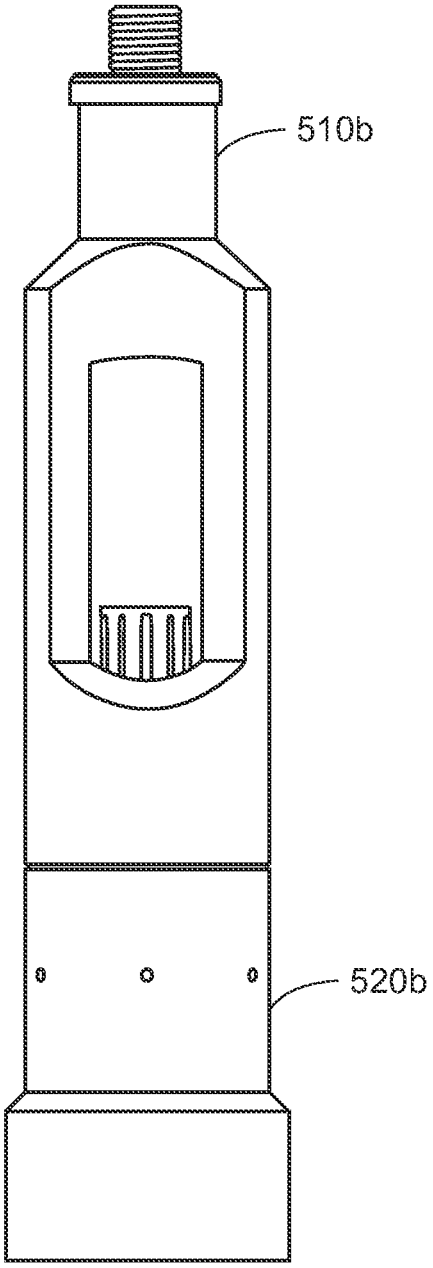
FIG. 5B is a front view of an example apparatus for sampling material that has been dislodged from a wall of a wellbore formed in a subterranean formation. The apparatus of FIG. 5B has a larger gauge cutter in comparison to the apparatus of FIG. 5A.

The cutting capability of the apparatus 100 can be adjusted by increasing dimension(s) (for example, diameter) of the second body 120, the cutter blade 121, or both the second body 120 and the cutter blade 121. As mentioned previously, in some implementations, the cutter blade 121 can be replaced by a cutter blade of a different size, such that the apparatus 100 can accommodate a differently sized tubing. FIGS. 5A and 5B are front views of example apparatuses 500*a* and 500*b*, respectively, for sampling material that has been dislodged from a wall of a wellbore formed in a subterranean formation. The apparatuses 500*a* and 500*b* can be substantially similar to the apparatus 100. The apparatuses 500*a* and 500*b* are substantially similar but have differently sized cutter blades. The cutter blade of apparatus 500*b* has a larger diameter in comparison to the cutter blade of apparatus 500*a*. Therefore, the apparatus 500*b* is sized to dislodge debris from the inner wall of a tubing having a diameter that is larger than a tubing for which the apparatus 500*a* is sized. In some cases, the first body 510*a* and divider 540*a* of apparatus 500*a* are the same as the first body 510*b* and divider 540*b* of apparatus 500*b*, respectively. In some cases, the second body 520*a* and cutter blade of apparatus 500*a* are sized differently from the second body 520*b* and cutter blade of apparatus 500*b* to accommodate differently sized tubing.

Figure 6:
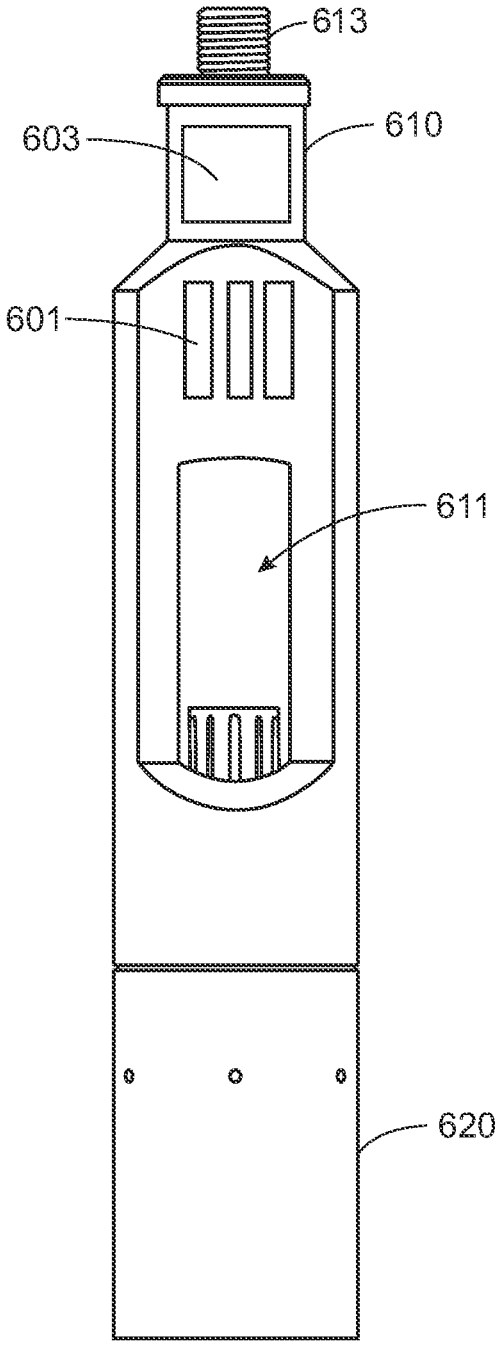
FIG. 6 is a front view of an example apparatus for sampling material that has been dislodged from a wall of a wellbore formed in a subterranean formation.

FIG. 6 is a front view of an example apparatus 600 for sampling material that has been dislodged from a wall of a wellbore formed in a subterranean formation. The apparatus 600 can be substantially similar to the apparatus 100. The apparatus 600 can include a magnet 601. In some implementations, the magnet 601 is located on an outer surface of the first body 610. In some implementations, the magnet 601 is located farther away from the second body 620 in comparison to the opening 611. For example, the magnet 601 can be located uphole in comparison to the opening 611. The magnet 601 is configured to attract and retain ferromagnetic materials, such as iron, steel, nickel, and cobalt.

The apparatus 600 can include a sensor unit 603. In some implementations, as shown in FIG. 6, the sensor unit 603 is located on an outer surface of the first body 610. In some implementations, as shown in FIG. 6, the sensor unit 603 is located in between the opening 611 and the connector head 613. In some implementations, the sensor unit 603 is located in between the opening 611 and the second body 620. In some implementations, the sensor unit 603 is located on an outer surface of the second body 620. The sensor unit 603 can include a casing-collar locator, an inclination sensor, a pressure sensor, a temperature sensor, or any combination of these. A casing-collar locator (CCL) is a magnetic device which can locate certain downhole equipment, such as collars, joints, packers, and centralizers by detecting changes in metal volume. A CCL can be used to correlate measurements and/or samples to depth within a wellbore. An inclination sensor is a device which can measure deviation angle from a true vertical. A pressure sensor is a device which can measure pressure (for example, a fluidic pressure within the wellbore). A temperature sensor is a device which can measure temperature (for example, a fluidic temperature or wall temperature within the wellbore). The data collected by the sensor unit 603 can be used to determine characteristics of the debris collected by the apparatus 600, characteristics of the local environment from which the collected debris originated, or both. In some implementations, the sensor unit 603 can collect data while the apparatus 600 is in the open position, while the apparatus 600 is activated, and while the apparatus 600 is in the closed position. In some implementations, the sensor unit 603 is activated and begins to collect data once the apparatus 600 is in the closed position. In some implementations, the sensor unit 603 is activated and begins to collect data once the apparatus 600 is activated (shifts away from the open position) and continues to collect data once the apparatus 600 is in the closed position. In some implementations, the sensor unit 603 is activated and begins to collect data once the apparatus 600 is activated (shifts away from the open position) and stops collecting data once the apparatus 600 is in the closed position.

Figure 7:
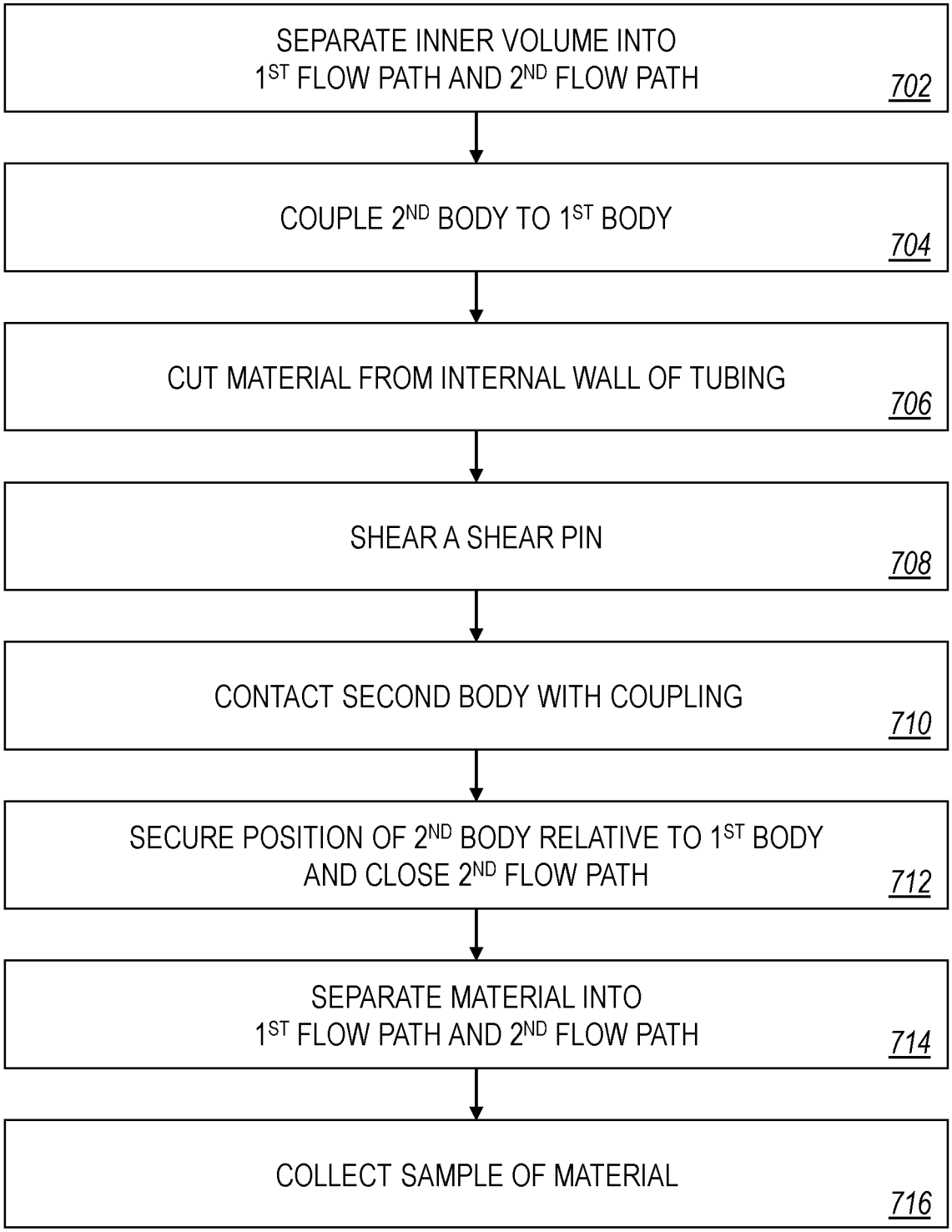
FIG. 7 is a flow chart of an example method for sampling material that has been dislodged from a wall of a wellbore formed in a subterranean formation.

FIG. 7 is a flow chart of an example method 700 for sampling material that has been dislodged from a wall of a wellbore formed in a subterranean formation. The method 700 can be implemented by any of apparatus 100, apparatus 400*a*, apparatus 400*b*, apparatus 500*a*, apparatus 500*b*, or apparatus 600. However, simply for clarity in explanation, the method 700 will be described in relation to apparatus 100. At block 702, the inner volume (defined by first and second bodies 110, 120) is separated by the divider 140 into a first flow path through the apparatus 100 and a second flow path through the apparatus 100. The first flow path is defined through the inner bore 141 of the divider 140. The second flow path is defined through the annulus 143 surrounding the divider 140.

At block 704, the second body 120 is coupled to the first body 110 by the shear pin 130. The shear pin 130 secures a position of the second body 120 relative to the first body 110 in the open position at block 704. In some implementations, the shear pin 130 passes through the opening 125 of the second body 120 and extends into the first body 110 to couple the second body 120 to the first body 110 at block 704. The apparatus 100 remains in the open position while the shear pin 130 is intact.

At block 706, a material is cut from an inner wall of a tubing in a wellbore by the cutter blade 121 during a downhole motion of the apparatus 100 through the tubing. Cutting the material from the inner wall of the tubing at block 706 releases the material from the inner wall of the tubing.

In response to cutting the material from the inner wall of the tubing at block 706, the shear pin 130 is sheared at block 708. For example, cutting the material from the inner wall of the tubing by the cutter blade 121 at block 706 can impart a force on the shear pin 130 and cause the shear pin 130 to shear at block 708. Shearing the shear pin 130 at block 708 decouples the first and second bodies 110, 120, such that the second body 120 is allowed to move relative to the first body 110.

At block 710, the second body 120 is contacted by the second coupling 123 during the downhole motion of the apparatus 100 through the tubing. In response to the second coupling 123 contacting the second body 120 at block 710, the position of the second body 120 relative to the first body 110 is secured in the closed position, and the second flow path is closed at block 712. For example, the second coupling 123 re-couples the second body 120 to the first body 110, such that the position of the second body 120 relative to the first body 110 is secured once again. Once re-coupled, the contact between the first and second bodies 110, 120 can close off an end of the second flow path, such that the second flow path ends with the annulus 143. In the closed position, fluids and solids are prevented from flowing from the annulus 143 and directly out of the apparatus 100 through the downhole end 120*b* of the second body 120.

At block 714, the material (cut from the inner wall of the tubing at block 706) is separated by the divider 140 during an uphole motion of the apparatus 100 through the tubing. The material is separated into the first flow path through the apparatus 100 and the closed second flow path into the annulus 143 at block 714.

At block 716, at least a portion (sample) of the material (that flows into the annulus 143 at block 714) is collected (retained) in the annulus 143 (sampling volume). In some implementations, the first body 110 is disconnected from the second body 120 to access the sample collected at block 716. In some implementations, the sample collected at block 716 is analyzed using an x-ray diffraction test, an acid test, or both.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. A wellbore gauge cutter apparatus comprising:

a first body defining a first opening and comprising a snap ring;

a second body comprising a gauge cutter configured to dislodge solids from an inner wall of a wellbore, wherein the snap ring of the first body is configured to hold a relative position of the second body to the first body in a closed position in response to the snap ring contacting the second body, wherein the first body and the second body cooperatively define an inner volume, and the second body defines a second opening;

a shear pin passing through the second opening and extending into the first body, wherein the shear pin is configured to hold the relative position of the second body to the first body in an open position while the shear pin is intact, and the second body is configured to be able to move relative to the first body in response to the shear pin being sheared; and a hollow cylindrical divider disposed within the inner volume, the hollow cylindrical divider defining an inner bore, wherein:

in the open position, the wellbore gauge cutter apparatus defines:

a first flow path for fluids and solids to pass through the wellbore gauge cutter apparatus, the first flow path defined through the first opening, through the inner bore of the hollow cylindrical divider, and through the gauge cutter, and a second flow path for fluids and solids to pass through the wellbore gauge cutter apparatus, the second flow path defined through the first opening, through an annulus surrounding the hollow cylindrical divider, and through the gauge cutter; and in the closed position, the second flow path is closed, such that solids remain in the annulus surrounding the hollow cylindrical divider.

2. The wellbore gauge cutter apparatus of claim 1, wherein:

the first body comprises a first uphole end and a first downhole end;

the first opening is located between the first uphole end and the first downhole end; and the snap ring is located between the first opening and the first downhole end.

3. The wellbore gauge cutter apparatus of claim 2, wherein the second body comprises:

a second uphole end;

a second downhole end; and an outer wall extending from the second uphole end to the second downhole end, and the second opening is located on and extends through the outer wall.

4. The wellbore gauge cutter apparatus of claim 3, wherein the gauge cutter is located at the second downhole end.

5. The wellbore gauge cutter apparatus of claim 4, wherein the snap ring has an outer profile that complements an inner profile of the second body, and the snap ring is configured to hold the relative position of the second body to the first body in the closed position in response to the snap ring contacting the inner profile of the second body.

6. The wellbore gauge cutter apparatus of claim 5, wherein the hollow cylindrical divider defines a plurality of apertures.

7. The wellbore gauge cutter apparatus of claim 6, wherein the first body comprises a connector head located at the first uphole end, the connector head configured to interface with a sucker rod or wireline.

8. The wellbore gauge cutter apparatus of claim 7, wherein the first body comprises a magnet disposed on an outer surface of the first body.

9. The wellbore gauge cutter apparatus of claim 7, comprising a sensor unit comprising a casing-collar locator, an inclination sensor, a pressure sensor, a temperature sensor, or a combination thereof.

10. An apparatus comprising:

a first body comprising a coupling;

a second body comprising a cutter blade, wherein the coupling is separated from contact with the second body in an open position and is configured to couple the first body to the second body in a closed position in response to the coupling contacting the second body, wherein the first body and the second body cooperatively define an inner volume;

a shear pin extending from the second body and into the first body, wherein the shear pin is configured to hold the position of the second body relative to the first body in the open position while the shear pin is intact, and the second body is configured to be able to move relative to the first body in response to the shear pin being sheared; and a divider disposed within the inner volume, the divider defining an inner bore, wherein:

in the open position, the apparatus defines:

a first flow path for fluids and solids to pass through the apparatus, the first flow path defined through the first body and through the inner bore of the divider, and a second flow path for fluids and solids to pass through the apparatus, the second flow path defined through the first body and through an annulus surrounding the divider; and in the closed position, the second flow path is closed, such that solids remain in the annulus surrounding the divider.

11. The apparatus of claim 10, wherein the divider is threadedly coupled to the first body.

12. The apparatus of claim 11, wherein the cutter blade is a gauge cutter configured to dislodge solids from an inner wall of a wellbore.

13. The apparatus of claim 12, wherein the coupling comprises a snap ring that has an outer profile that complements an inner profile of the second body.

14. The apparatus of claim 13, wherein the divider is cylindrical and defines a plurality of apertures.

15. The apparatus of claim 14, wherein the first body comprises a connector head configured to interface with a sucker rod or wireline.

16. The apparatus of claim 15, wherein the first body comprises a magnet disposed on an outer surface of the first body.

17. The apparatus of claim 15, comprising a sensor unit comprising a casing-collar locator, an inclination sensor, a pressure sensor, a temperature sensor, or a combination thereof.

18. A method implemented by a gauge cutter apparatus comprising a first body, a second body, a shear pin, and a divider, wherein the first body comprises a snap ring, the second body comprises a gauge cutter, the first body and the second body define an inner volume, the divider is disposed within the inner volume, and the method comprises:

separating, by the divider, the inner volume into a first flow path through the gauge cutter apparatus and a second flow path through the gauge cutter apparatus, wherein the first flow path is defined through an inner bore of the divider, and the second flow path is defined through an annulus surrounding the divider;

coupling, by the shear pin, the second body to the first body, thereby securing a position of the second body relative to the first body in an open position;

cutting, by the gauge cutter during a downhole motion of the gauge cutter apparatus through a tubing in a wellbore, a material from an inner wall of the tubing, such that the material is released from the inner wall of the tubing;

in response to the gauge cutter cutting the material from the inner wall of the tubing, shearing the shear pin, thereby allowing the second body to move relative to the first body;

contacting, by the snap ring during the downhole motion of the gauge cutter apparatus through the tubing, the second body;

in response to the snap ring contacting the second body, securing the position of the second body relative to the first body in a closed position and closing the second flow path, such that the second flow path ends with the annulus surrounding the divider;

separating, by the divider during an uphole motion of the gauge cutter apparatus through the tubing, the material into the first flow path through the gauge cutter apparatus and the closed second flow path into the annulus surrounding the divider; and collecting a sample of the material in the annulus surrounding the divider.

19. The method of claim 18, comprising disconnecting the first body from the second body to access the collected sample.

20. The method of claim 19, comprising analyzing the collected sample using an x-ray diffraction test, an acid test, or a combination thereof.

* * * * *